United States Patent [19]

Kita

[11] Patent Number: 4,485,463

[45] Date of Patent: Nov. 27, 1984

[54] TIME DISPLAY DEVICE WITH MEANS FOR SELECTIVELY READING OUT A PLURALITY OF PREVIOUS SET TIMES

[75] Inventor: Kazunori Kita, Tokyo, Japan

[73] Assignee: Casio Computer Co., Ltd., Tokyo, Japan

[21] Appl. No.: 447,525

[22] Filed: Dec. 7, 1982

Related U.S. Application Data

[63] Continuation of Ser. No. 197,269, Oct. 15, 1980, abandoned.

[30] Foreign Application Priority Data

| | | | |
|---|---|---|---|
| Oct. 22, 1979 | [JP] | Japan | 54-135205 |
| Oct. 22, 1979 | [JP] | Japan | 54-135206 |
| Oct. 22, 1979 | [JP] | Japan | 54-135207 |
| Oct. 22, 1979 | [JP] | Japan | 54-135209 |

[51] Int. Cl.[3] ..... G09G 3/04

[52] U.S. Cl. ..... 368/82; 340/716; 340/765; 340/792; 340/715; 368/41

[58] Field of Search ..... 368/10, 41, 82; 340/716, 784, 763, 765, 783, 792, 715

[56] References Cited

U.S. PATENT DOCUMENTS

| | | | |
|---|---|---|---|
| 3,999,050 | 12/1976 | Pitroda | 368/10 |
| 4,162,610 | 7/1979 | Levine | 368/10 |
| 4,231,640 | 11/1980 | Funada et al. | 340/716 |
| 4,335,936 | 6/1982 | Nonomura et al. | 340/784 |
| 4,371,870 | 2/1983 | Biferno | 340/716 |

*Primary Examiner*—Marshall M. Curtis

*Attorney, Agent, or Firm*—Frishauf, Holtz, Goodman and Woodward

[57] ABSTRACT

A time display device includes a memory, in which a plurality of successive time data items are memorized. With the operation of an external manual switch, two or more time data items among those memorized in the memory are read out and supplied to an optical display unit. Two or more time data items are simultaneously displayed in the optical display unit.

17 Claims, 35 Drawing Figures

TO DISPLAY CONTROL CIRCUIT 9
TO FIRST TIME TABLE CONTROL CIRCUIT 5
TO SECOND TIME TABLE CONTROL CIRCUIT 6
P
X
Y
p'
p
a
b
c
d
e
f
g
h
PRESET
NORMAL
ONE-SHOT
3C-R COUNTER
CK
S
R
Q
T
P/S
φA
S1
S2
S3
S4
S5
S6
7
8
21
22
23
24
25
26
27
28
29
31
32
33
34
35
36
37
38
39
40
41
42
43

FIG. 6

82

| TIME DATA | RAM ADDRESS | | DATA |
|---|---|---|---|
| | COLUMN ADDRESS | LINE ADDRESS | |
| 0:00 | 00000 | 000000 | 0 |
| 0:01 | 00000 | 000001 | 0 |
| 0:02 | 00000 | 000010 | 0 |
| 0:03 | 00000 | 000011 | 0 |
| ⌇ | ⌇ | ⌇ | ⌇ |
| 6:54 | 00110 | 110110 | 1 |
| 6:55 | 00110 | 110111 | 1 |
| ⌇ | ⌇ | ⌇ | ⌇ |
| 7:26 | 00111 | 011010 | 0 |
| 7:27 | 00111 | 011011 | 1 |
| 7:28 | 00111 | 011100 | 0 |
| 7:29 | 00111 | 011101 | 1 |
| 7:30 | 00111 | 011110 | 0 |
| ⌇ | ⌇ | ⌇ | ⌇ |
| 7:48 | 00111 | 110000 | 0 |
| 7:49 | 00111 | 110001 | 1 |
| 7:50 | 00111 | 110010 | 0 |
| ⌇ | ⌇ | ⌇ | ⌇ |
| 8:03 | 01000 | 000011 | 1 |
| 8:04 | 01000 | 000100 | 0 |
| 8:05 | 01000 | 000101 | 1 |
| ⌇ | ⌇ | ⌇ | ⌇ |
| 8:43 | 01000 | 101011 | 1 |
| 8:44 | 01000 | 101100 | 0 |
| ⌇ | ⌇ | ⌇ | ⌇ |
| 9:51 | 01001 | 110011 | 0 |
| 9:52 | 01001 | 110100 | 1 |
| ⌇ | ⌇ | ⌇ | ⌇ |
| 23:58 | 10111 | 111010 | 0 |
| 23:59 | 10111 | 111011 | 0 |

a
b
c
d
e
f
g
110
151
152
153
154
155
156
157
158
159
160
161
162
163
164
165
166
167
168
169
170
171
172
173
174
175
176
177
181
182
186
189
201
3C
R S Q
R S Q̄
ØA

TIME DISPLAY DEVICE WITH MEANS FOR SELECTIVELY READING OUT A PLURALITY OF PREVIOUS SET TIMES

This is a continuation of application Ser. No. 197,269 filed Oct. 15, 1980 now abandoned.

BACKGROUND OF THE INVENTION

This invention relates to a time display device with which a number of time data items can be read out and displayed when desired.

Recently, it has been in practice to provide time display devices such as timepieces with functions additional to the timepiece function such as functions of permitting desired data, for instance train and bus departure time tables and schedules, to be memorized and selectively displayed as a time display in a display unit.

However, with the prior art time display device of this kind, only one time data item can be displayed at one time. This is sometimes inconvenient.

Also, in such prior art devices a number of time data items have to be previously written in the memory, and the writing of a number of time data items requires very troublesome operations of input switches and also a long time.

The invention has been developed in view of the above drawbacks in the prior art time display device, and the object is to provide a time display device, with which a number of time data items previously memorized can be read out and displayed when desired, and also which permits display of a plurality of time data items at one time and also the reading of relations of time data items such as the order or sequence thereof.

Another object of the invention is to provide a time display device, with which a number of time data items can be memorized in a memory with a simple switch operation.

SUMMARY OF THE INVENTION

To achieve the above objective, the time display device according to the invention comprises a memory means for memorizing a plurality of time data items, an optical display means capable of displaying two or more time data items memorized in said memory means, a manual switch means for reading out two or more successive time data items among those memorized in said memory means, and a display control means for causing said two or more successive time data items read out from said memory with the operation of said manual switch means to be displayed in said optical display means.

With this construction according to the invention, with which a number of time data items can be previously memorized and can be read out and displayed when desired, it is possible to display a number of time data items at one time and to read out relations of time data items such as the order and sequence thereof, and this is very beneficial. In addition, a number of time data items can be memorized in a memory with a simple switch operation.

BRIEF DESCRIPTION OF THE DRAWINGS

FIG. 6 is a view showing an example of data memory state of RAM 82 shown in FIG. 5B;

FIG. 17, show a circuit diagram of schedule control circuit 110 shown in FIG. 14.

DETAILED DESCRIPTION

Figure 1:
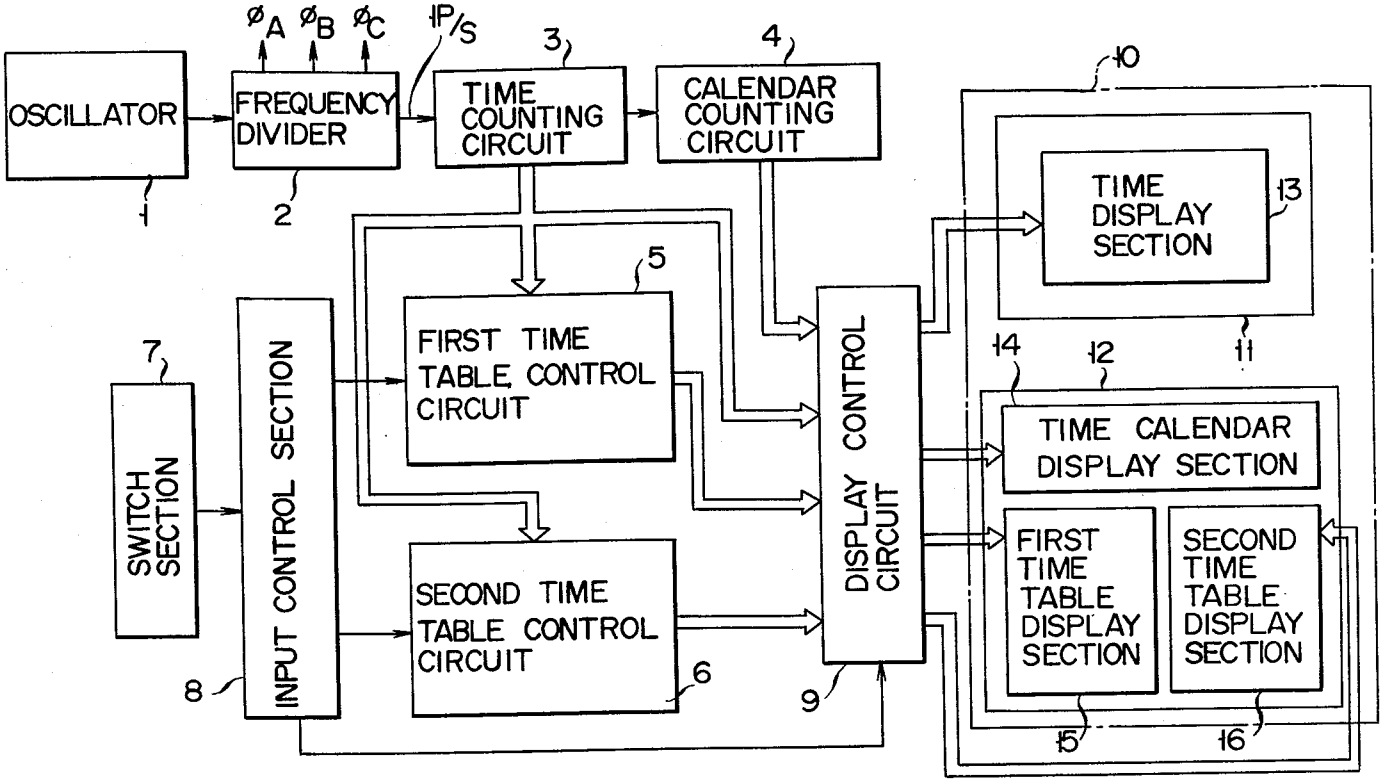
FIG. 1 is a block diagram showing an embodiment of the time display device according to the invention.
Figure 2A:
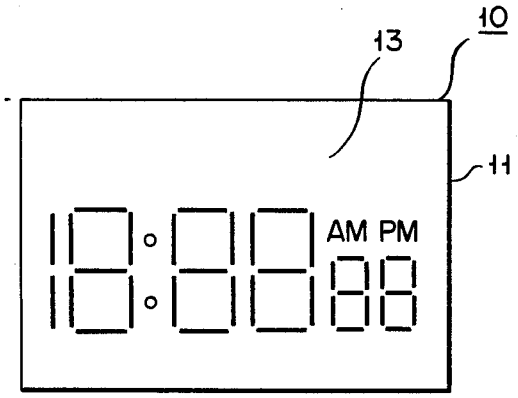
FIGS. 2A and 2B are views respectively showing upper and lower display sections 11 and 12 in display unit 10 shown in FIG. 1.
Figure 2B:
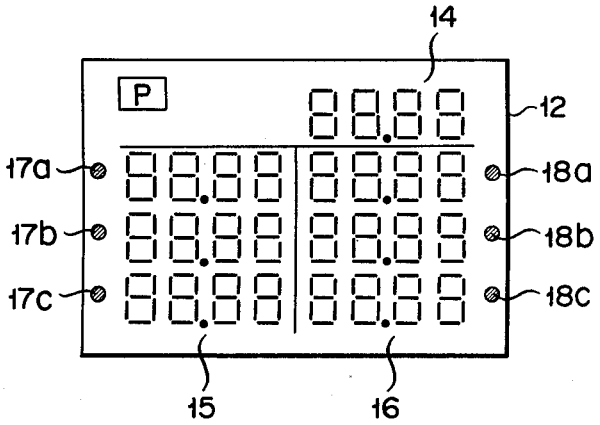

Now, an embodiment of the invention will be described with reference to drawings. FIG. 1 outlines the embodiment of the invention applied to an electronic timepiece. In the Figure, an oscillator 1 produces a reference signal for the timepiece. This reference signal is supplied to a frequency divider 2. The frequency divider 2 divides the reference signal to produce clock pulse signals $\emptyset_A$, $\emptyset_B$ and $\emptyset_C$ and also a signal having a period of, for instance, one second. The clock pulse signals $\emptyset_A$, $\emptyset_B$ and $\emptyset_C$ have the same period, and the signals $\emptyset_A$ and $\emptyset_B$ are 180° out of phase with each other. The clock pulse signal $\emptyset_C$ has a duty ratio of one half, and its "1" and "0" levels correspond respectively to, for instance, the clock pulse signals $\emptyset_A$ and $\emptyset_B$. The one-second signal produced from the frequency divider 2 is supplied to a time counting circuit 3. The time counting circuit 3 counts the input one-second signal pulses to obtain "hour", "minute" and "second" information and also a 24-hour signal having a period of 24 hours. The 24-hour signal is supplied to a calendar counting circuit 4. The time information produced from the time counting circuit 3 is supplied to first and second time table control circuits 5 and 6. As will be described in detail hereinafter, the first and second time table control circuits 5 and 6 each include an internal memory for memorizing a plurality of time data items such as those of a time table and has a function of reading and writing data, and they are operated according to instructions supplied from a switch section 7 through an input control circuit 8. The time information from the time counting circuit 3, calendar (month and day) information from the calendar counting circuit 4 and time information from the first and second time table control circuits 5 and 6 are coupled to a display control circuit 9. The display control circuit 9 selectively transfers the input time data coupled from the above circuits to a display unit 10 according to a selection signal from the input control circuit 8. The display unit 10 includes two liquid crystal display devices overlapped over one another and respectively constituting upper and lower display sections 11 and 12. In the upper display section 11 a time display section 13 is formed, and in the lower display section 12 a time/calendar display section 14 and first and second time table display sections 15 and 16 are formed. As shown in FIG. 2A, the time display section 13 has six digits of display electrodes for digitally displaying "hour", "minute" and "second" data and "AM" and "PM" display electrodes for displaying the ante meridiem and post meridiem data. The lower display section 12 has a construction as shown in FIG. 2B. More particularly, it has four digits of display electrodes for digitally displaying the present "hour" and "minute" information or present "month" and "day" information and a "P" display electrode for displaying a presetting mode. The first and second time table display sections 15 and 16 individually have four display electrode rows each consisting of four digits of display electrodes for digitally displaying "hour" and "minute" data, and also they have respective presetting display electrodes 17*a* to 17*c* and 18*a* to 18*c* for displaying that the corresponding display electrode rows are preset.

Figure 3A:
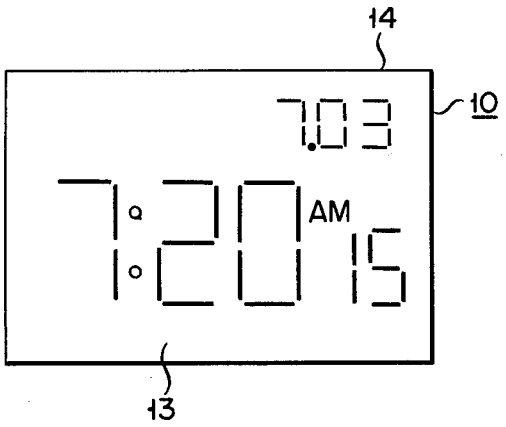
FIGS. 3A and 3B are views showing examples of the display in the display unit 10.
Figure 3B:
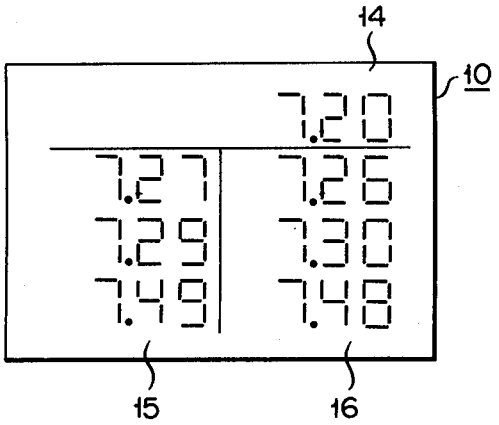

In the above construction, time data of, for instance, a train departure time table are written in the internal memory of the first time table control circuit 5, and time data of, for instance, a bus departure time table are written in the internal memory of the second time table control circuit 6. Normally, the time information and calendar information being counted in the respective time counting circuit 3 and calendar counting circuit 4 are supplied through the display control circuit 9 to the display unit 10 and displayed in the time display section 13 and time/calendar display section 14, as shown in FIG. 3A. The Figure shows an example of the display state, in which data representing "March 7, ante meridiem, 7 o'clock, 20 minutes and 15 seconds" are displayed. If a time table display instruction is given in this state with a switch operation in the switch section 7, the input control circuit 8 supplies a time table read command to the first and second time table control circuits 5 and 6 and also supplies a display switching command to the display control circuit 9. According to this display switching command the display control circuit 9 effects switching of the display, so that the time information from the time counting circuit 3 and time table data read out from the first and second time table control circuits 5 and 6 are supplied to the time/calendar display section 14 and first and second time table display sections 15 and 16 for display. FIG. 3B shows an example of the time table display. In this example, information "7:20" is displayed as present time in the time/calendar display section 14, train departure times of "7:27", "7:29" and "7:49" are displayed in the first time table display section 15, and bus departure times of "7:26", "7:30" and "7:48" are displayed in the second time table display section 16. In this case, three time data items are read out from each of the first and second time table control circuits 5 and 6 and displayed in each of the display sections 15 and 16.

Figure 4:
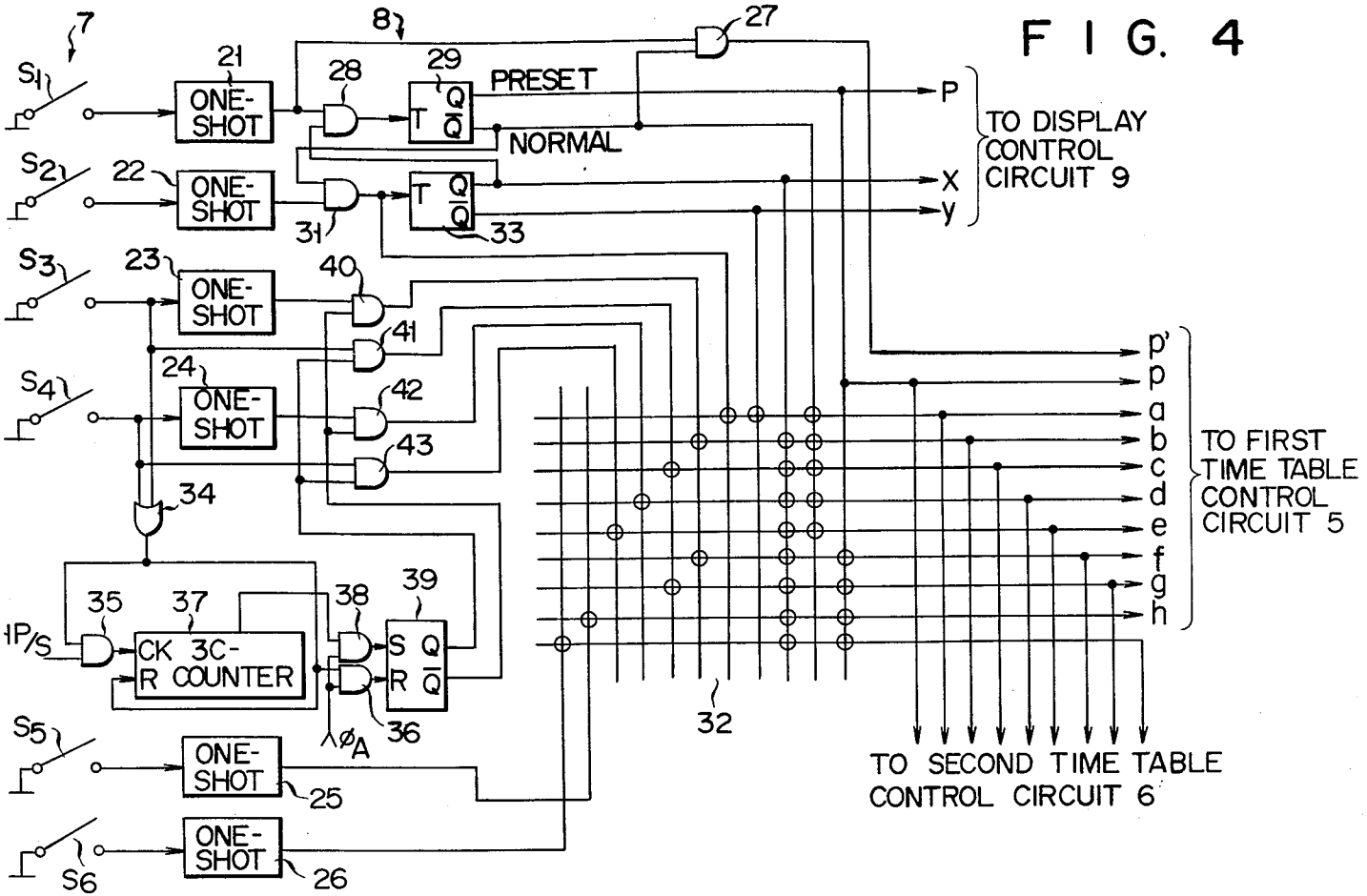
FIG. 4 is a schematic showing switch section 7 and input control circuit 8 shown in FIG. 1.

FIG. 4 shows in detail the switch section 7 and input control circuit 8, which will now be described. The switch section 7 has a switch $S_1$ for switching presetting and normal modes, a switch $S_2$ for switching time display and time table display modes, a switch $S_3$ for effecting a "+1" shift, a switch $S_4$ for effecting a "−1" shift, a switch $S_5$ for setting a first time table and a switch $S_6$ for setting a second time table. The outputs produced from these switches $S_1$ to $S_6$ when these switches are operated are coupled to respective one-shot circuits 21 to 26. The output of the one-shot circuit 21 is coupled to an AND gate 27, and is also adapted to be coupled through an AND gate 28 to a trigger terminal T of a T-type flip-flop 29. The Q side output of the flip-flop 29 is supplied as a preset signal P to the display control circuit 9, and is also coupled to a decoder 32. The $\overline{Q}$ side output of the flip-flop 29 is coupled to the AND gate 27, and is also adapted to be coupled through an AND gate 31 to the decoder 32. The output of the one-shot circuit 22 is coupled to the AND gate 31, and the output thereof is coupled to a trigger terminal T of a T-type flip-flop 33. The $\overline{Q}$ side output of the flip-flop 33 is coupled to the decoder 32, and is also supplied as a time display signal y to the display control circuit 9. The Q side output of the flip-flop 33 is coupled to the AND gate 28 and decoder 32, and is also supplied as a time table display signal x to the display control circuit 9. The outputs of the switches $S_3$ and $S_4$, which are coupled to the aforementioned respective one-shot circuits 23 and 24, are also coupled through an OR gate 34 to AND gates 35 and 36 and a reset terminal R of a three-scale of counter 37. One-second signal 1P/S produced from the frequency divider 2 is coupled to the AND gate 35, and the output thereof is coupled to a clock input terminal CK of the three-scale of counter 37. The output of the three-scale of counter 37 is coupled as a carry signal to an AND gate 38. The clock pulse signal $\emptyset_A$ from the frequency divider 2 is coupled to the AND gates 38 and 36, and the outputs of these AND gates 38 and 36 are respectively coupled to a set terminal S and a reset terminal R of an S-R flip-flop 39. The $\overline{Q}$ side output of the flip-flop 39 is coupled to AND gates 40 and 42, while the Q side output of the flip-flop is coupled to AND gates 41 and 43. To the AND gates 40 and 42 are respectively coupled the one-shot pulse outputs of the one-shot circuits 23 and 24, and to the AND gates 41 and 43 are respectively coupled the outputs of the switches $S_3$ and $S_4$. The outputs of the AND gates 40 to 43 are coupled to the decoder 32. The one-shot pulse outputs of the one-shot circuits 25 and 26 are also coupled to the decoder 32. The decoder 32 comprises AND gates and produces control commands a to h according to the operation of the switches $S_1$ to $S_6$. The output signals a to h, Q side output P of the flip-flop 29 and output P' of the AND gate 27 are supplied to the first and second time table control circuits 5 and 6.

Figure 5A:
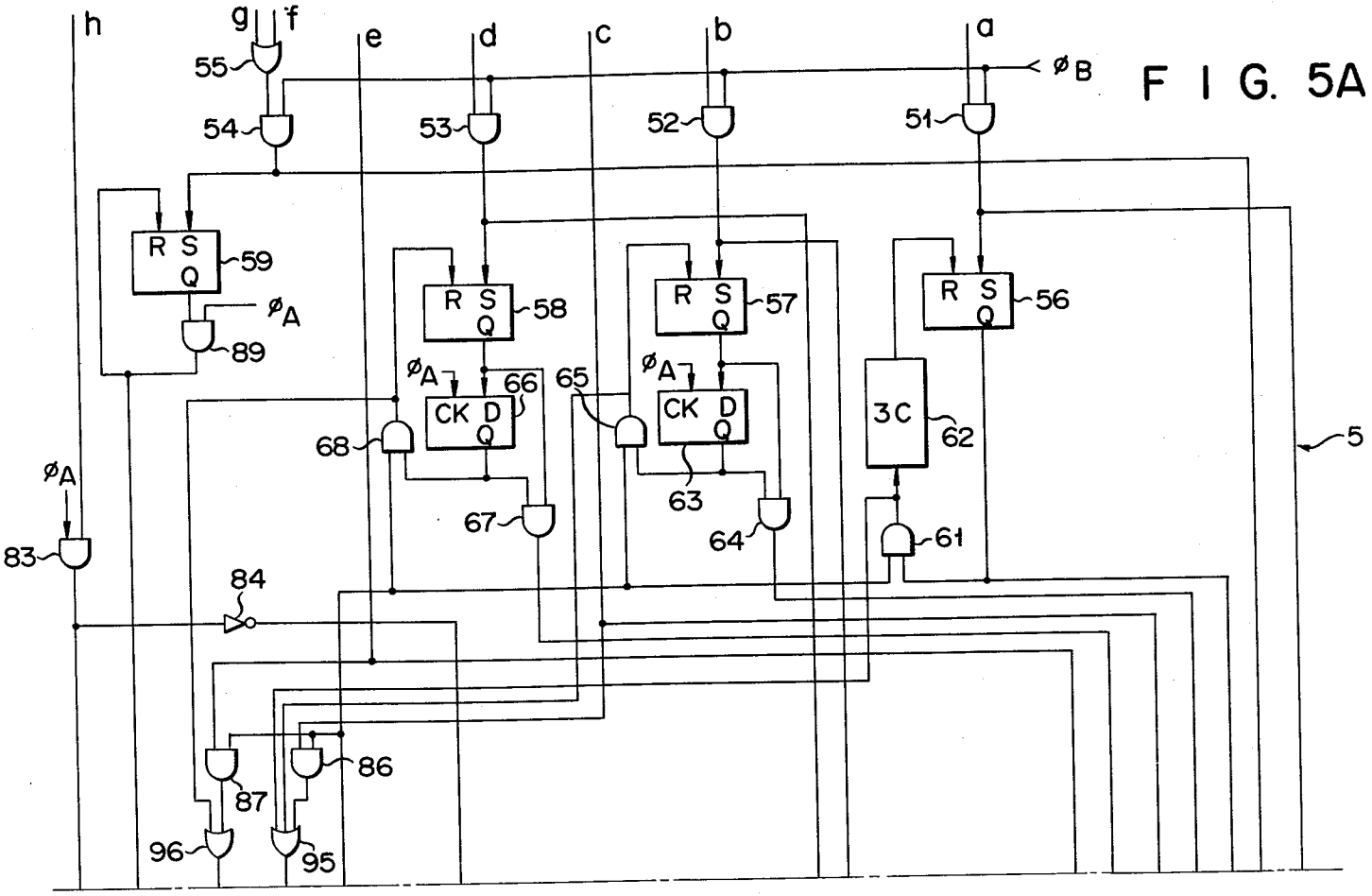
FIGS. 5A and 5B show a circuit diagram of a first time table control circuit 5 shown in FIG. 1.
Figure 5B:
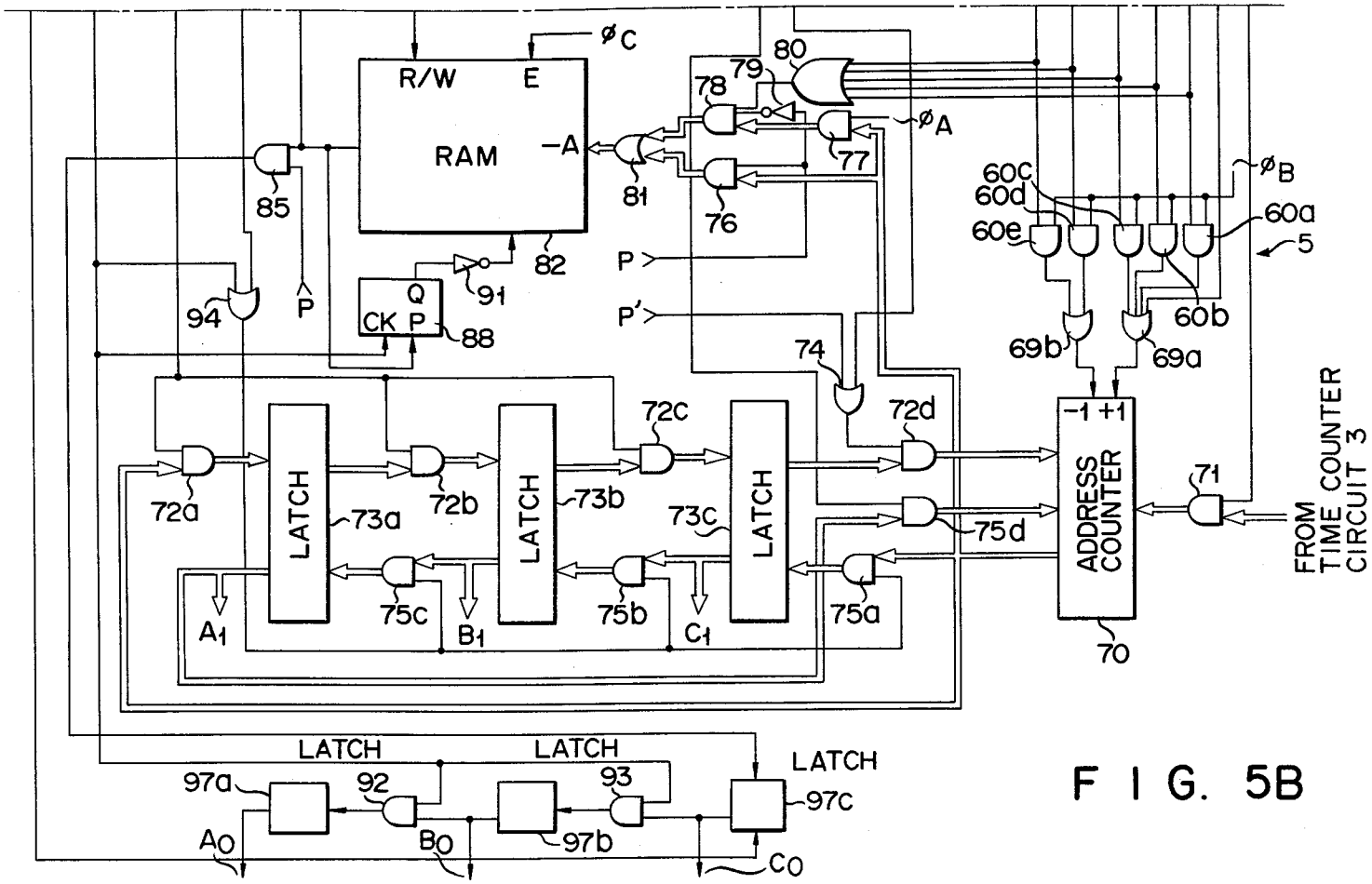

FIG. 5, consisting of FIGS. 5A and 5B, shows in detail either one of the first and second time table control circuits 5 and 6, which have the same construction. Only one of these circuits 5 and 6 will thus be described. In FIG. 5, the output signals a, b and d from the decoder 32 in the input control circuit 8 are coupled to respective AND gates 51 to 53. The output signals f and g of the decoder 32 are coupled through an OR gate 55 to an AND gate 54. The clock pulse signal $\emptyset_B$ from the frequency divider 2 is coupled to the AND gates 51 to 54. The outputs of the AND gates 51 to 54 are respectively coupled to set terminals S of S-R flip-flops 56 to 59. The output of the flip-flop 56 is coupled to an AND gate 60*a*, and is also coupled through an AND gate 61 to a three-scale of counter 62. The flip-flop 56 is reset by the output of the three-scale of counter 62. The output of the flip-flop 57 is coupled to an input terminal D of a D-type flip-flop 63 and also to an AND gate 64. The flip-flop 63 operates in synchronism with the clock pulse signal $\emptyset_A$ supplied to its clock input terminal CK, and its output is coupled to the AND gate 64 and also coupled through an AND gate 65 to a reset terminal R of the flip-flop 57. The output of the AND gate 64 is coupled to an AND gate 60*b*. The output of the flip-flop 58 is coupled to an input terminal D of a D-type flip-flop 58 is coupled to an input terminal D of a D-type flip-flop 66 and also to an AND gate 67. The flip-flop 66 operates in synchronism with the clock pulse signal $\emptyset_A$ supplied to its clock input terminal CK, and its output is coupled to an AND gate 68 and also coupled through an AND gate 68 to a reset terminal R of the flip-flop 58. The output of the AND gate 67 is coupled to an AND gate 60*d*. The output signals c and e from the decoder as mentioned above are coupled to respective AND gates 60*c* and 60*e*. The clock pulse signal $\emptyset_B$ is coupled to the AND gates 60*a* and 60*e*. The outputs of the AND gates 60*a* to 60*c* and 54 are coupled as a "+1" signal through an OR gate 69*a* to an address counter 70. The outputs of the AND gates 60*d* and 60*e* are coupled as a "−1" signal through an OR gate 69*b* to the address counter 70. Further, the time information from the time counting circuit 3 shown in FIG. 1 is supplied as address data through an AND gate 71 to the address counter 70 and preset therein. The address data in the address counter 70 is coupled through an AND gate 72*a* to a latch circuit 73*a*. The data latched in the latch circuit 73*a* is shifted through an AND gate 72*b* to a latch circuit 73*b*, and the data latched therein is shifted through an AND gate 72*c* to a latch circuit 73*c*. The data latched in the latch circuit 73*c* is loaded through an AND gate 72*d* to the address counter 70. The AND gate 72*d* is controlled for gating by the output of an OR gate 74, to which the output of the AND gate 52 and the signal P' as a preset mode signal from the input control circuit 8 shown in FIG. 4 are coupled. The address data in the address counter 70 is also coupled through an AND gate 75*a* to the latch circuit 73*c*, and then shifted through an AND gate 75*b* to the latch circuit 73*b*, then through an AND gate 75*c* to the latch circuit 73*a* and then through an AND gate 75*d* to the address counter 70. The AND gate 75*d* is controlled for gating by the output of the AND gate 53. The output of the address counter 70 is further coupled to AND gates 76 and 77. The AND gate 76 is controlled for gating by the signal P coupled as a presetting mode signal from the input control circuit 8. The AND gate 77 is controlled for gating by the clock pulse signal $\emptyset_A$, and its output is coupled to an AND gate 78. To the AND gate 78 are also coupled the output of an inverter 79, which inverts the presetting mode signal P, and the output of an OR gate 80, to which the outputs of the AND circuits 64 and 67 and the output signals c and e of the aforementioned decoder 32 are coupled. The outputs of the AND gates 76 and 78 are coupled as address data through an OR gate 81 to a random access memory (RAM) 82. The RAM 82 memorizes a time table and has, for instance, $24\times60=1{,}440$ sets of memory elements so that it can memorize time data for 24 hours at an interval of one minute. FIG. 6 shows an example of memorization of data in the RAM 82. As is shown, the presence and absence of time data for time instants spaced apart at an interval of one minute, namely from "0:00" through "23:59", are written in terms of "1" and "0" in corresponding addresses which are each specified by a 6-bit row address and a 5-bit column address. The clock pulse signal $\emptyset_C$ is coupled to an enable terminal E of the RAM 82, and the output signal h of the decoder 32 is coupled through an AND gate 83 and an inverter 84 to a write/read terminal R/W of the RAM 82. The clock pulse signal $\emptyset_A$ is coupled to the AND gate 83 for output timing control. The data read out from the RAM 82 is coupled to the AND gates 61, 65 and 68 and also to AND gates 85 to 87 and an input terminal D of a D-type flip-flop 88. The output of the flip-flop 59 is coupled through an AND gate 89 to a clock input terminal CK of the flip-flop 88, and the Q side output thereof is coupled through an inverter 91 to a data input terminal $D_{IN}$ of the RAM 82. The output of the AND gate 89 is also coupled to a reset terminal R of the flip-flop 59 and to AND gates 92 and 93, and is also coupled as a gating signal through an OR gate 94 to the AND gates 75*a* to 75*c*. The output signal c from the decoder 32 is also coupled to the AND gate 86, and the output thereof and the outputs of the AND gates 61 and 65 are coupled through an OR gate 95 to the OR gate 94. The output signal e from the decoder 32 is also coupled to the AND gate 87, and the output thereof is coupled as a gating signal through an OR gate 96 to the AND gates 72*a* to 72*c*. The preset signal P is connected to the AND gate 85, and the output thereof is coupled to a latch circuit 97*c* and latched therein. The latched data in the latch circuit 97*c* is transferred through the AND gate 93 to a latch circuit 97*b*, and the latched data therein is transferred through the AND gate 92 to a latch circuit 97*a*. The latched data $A_0$ to $C_0$ in the respective latch circuits 97*a* and 97*c* and the time information $A_1$ to $C_1$ latched in the respective latch circuits 73*a* to 73*c* are supplied to the display control circuit 9 shown in FIG. 1.

Figure 7:
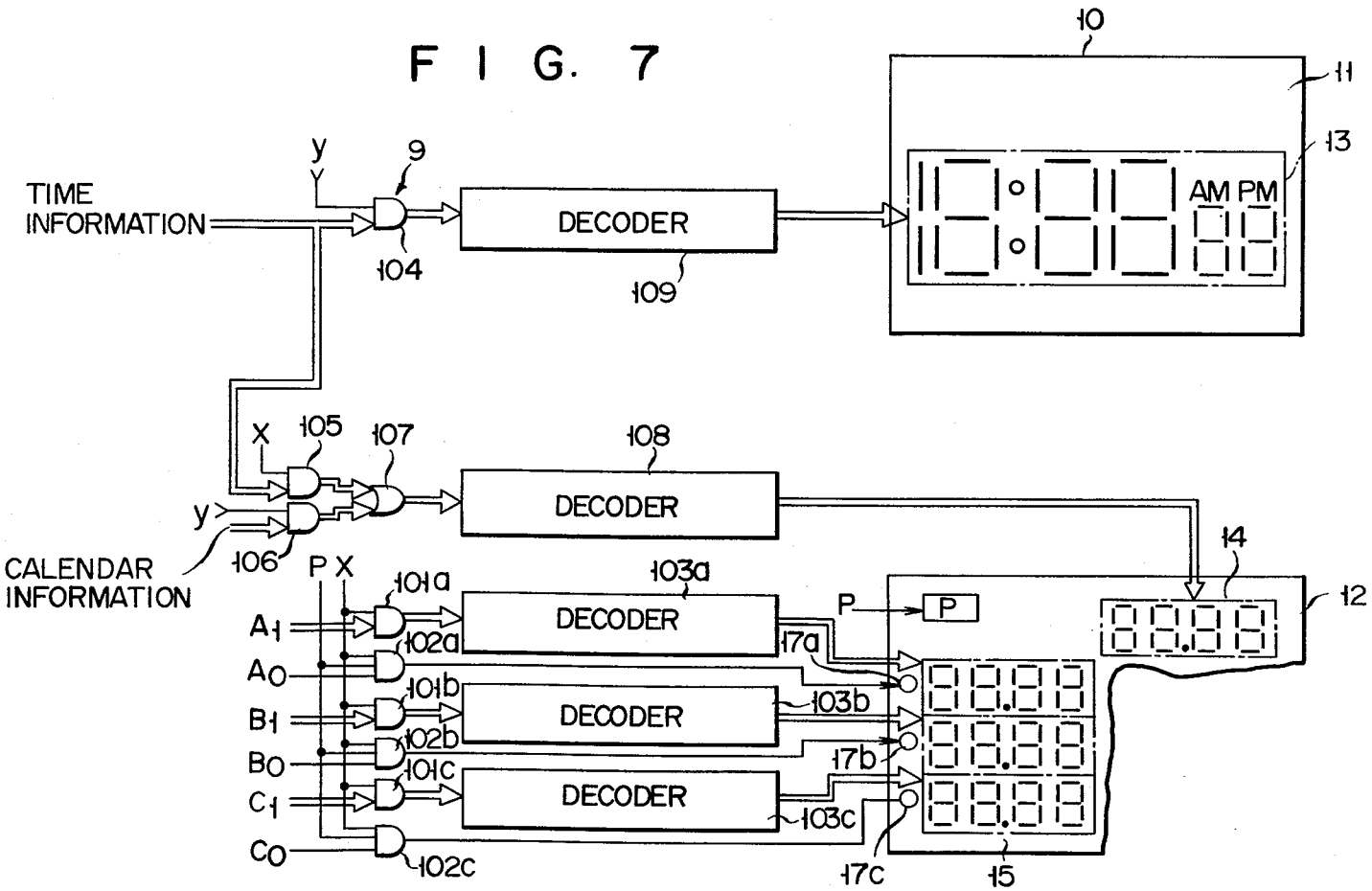
FIG. 7 is a schematic showing display control circuit 9 and display unit 10 shown in FIG. 1.

FIG. 7 shows the detailed construction of the display control circuit 9. The data $A_1$ to $C_1$ latched in the latch circuits 73*a* to 73*c* in the first time table control circuit 5, as shown in FIGS. 5A and 5B, are coupled to respective AND gates 101*a* to 101*c*, and the data $A_0$ to $C_0$ latched in the latch circuits 97*a* to 97*c* are coupled to respective AND gates 102*a* to 102*c*. The AND gates 101*a* to 101*c* are controlled for gating by the aforementioned time table display signal x, while the AND gates 102*a* to 102*c* are controlled for gating by the aforementioned presetting mode signal P. The outputs of the AND circuit 101*a* to 101*c* are supplied through respective decoders 103*a* to 103*c* to the first time table display section 15. The outputs of the AND gates 102*a* to 102*c* are supplied as drive signals for driving the respective setting display electrodes 17*a* to 17*c* in the time table display section 15. Like the display data from the left time table control circuit 5, the display data from the second time table control circuit 6 are similarly supplied through AND gates and decoders to the second time table display section 16. The time information supplied from the time counting circuit 3 shown in FIG. 1 to the display control circuit 9 is coupled to AND gates 104 and 105, and the calendar information from the calendar counting circuit 4 is coupled to an AND gate 106. The AND gates 104 and 106 are controlled for gating by the time display signal y, while the AND gate 105 is controlled for gating by the time table display signal x. The outputs of the AND gates 105 and 106 are coupled through an OR gate 107 to a decoder 108, and the output thereof is supplied to the time/calendar display section 14 in the lower display section 12. The preset mode signal from the input control circuit 8 is coupled to the "P" display electrode in the lower display section 12. The output of the AND circuit 104 is supplied through a decoder 109 to the time display section 13.

The operation of the construction described above according to the invention will now be described. In this embodiment, the individual component circuits are timed for their operation to the falling of the clock pulses. Normally, the flip-flop 33 in the input control circuit 8 shown in FIG. 4 is in the reset state, with its $\overline{Q}$ side output signal, i.e., the time display y, being "1". Thus, the AND gates 104 and 105 in the display control circuit shown in FIG. 7 are open, so that the time information from the time counting circuit 3 and calendar information from the calendar counting circuit 4 are respectively supplied through the decoders 109 and 108 to the time display section 13 and time/calendar display section 14 for the display of the present time and date as shown in FIG. 3A.

Figure 8:
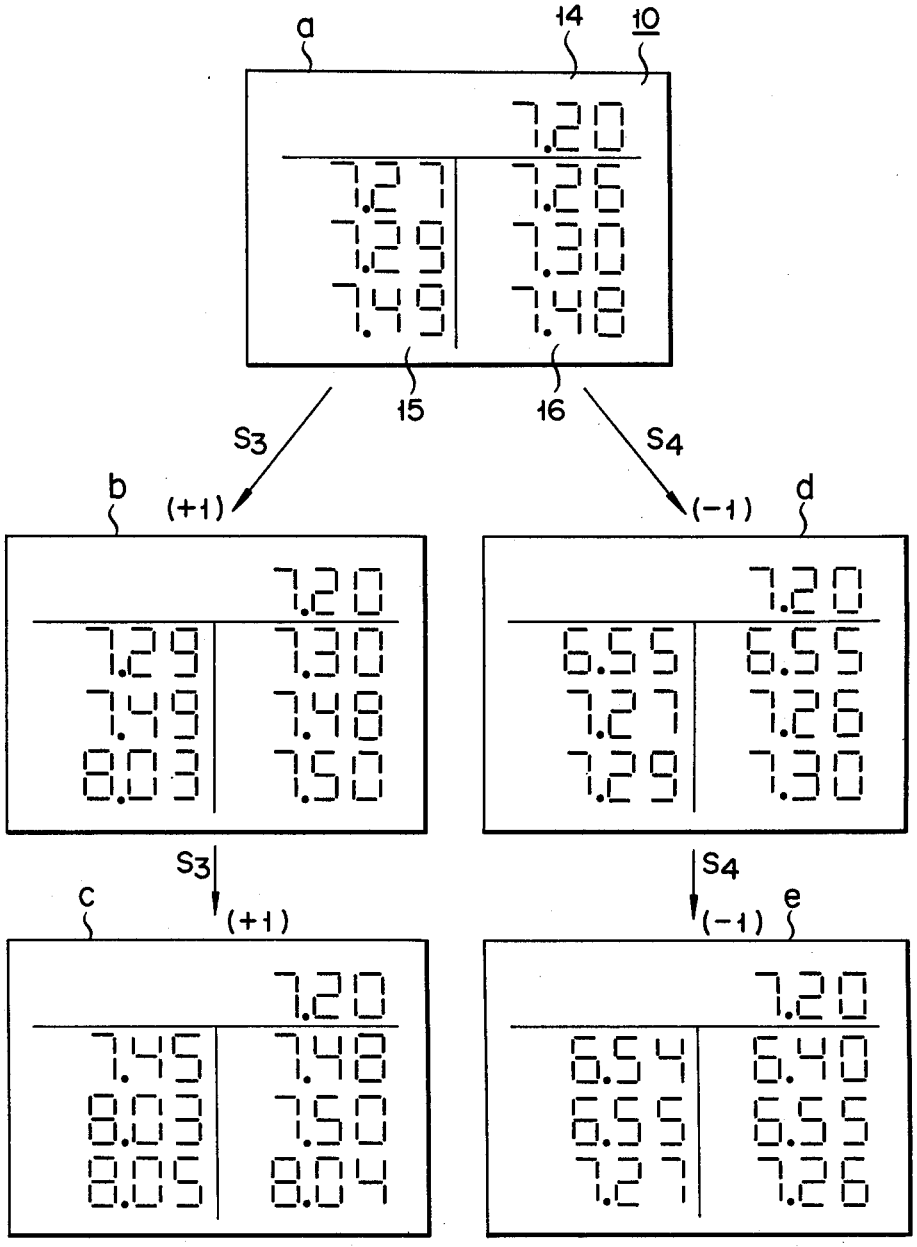
FIG. 8 shows examples of the display in the display unit 10.
Figure 9:
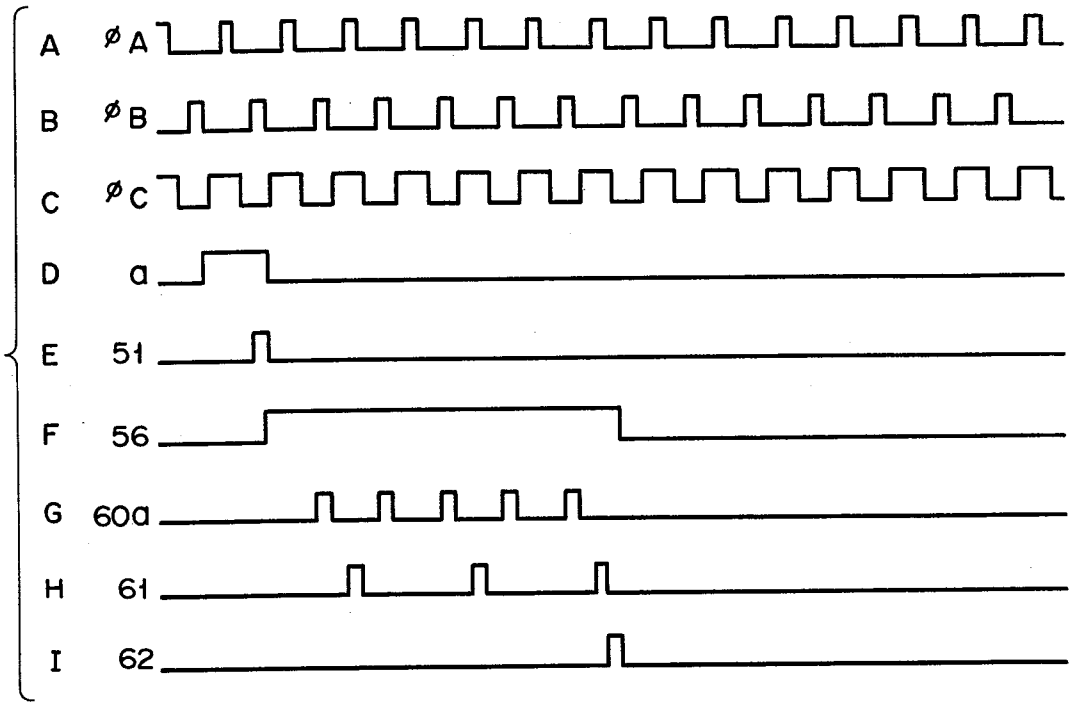
FIGS. 9A through 9I show a time chart illustrating the operation of first time table control circuit 5 at the time of mode switching.

For switching the above time display mode over to the time table display mode as shown in FIG. 3A, the switch $S_2$ in the switch section 7 shown in FIG. 4 is operated. With the operation of the switch $S_2$ a one-shot pulse is produced from the one-shot circuit 22 and coupled to the AND gate 31. Since at this instant a "1" signal coupled from the $\overline{Q}$ side output terminal of the flip-flop 29 prevails as an input to the AND gate 31, the output of the one-shot circuit 22 is coupled through the AND gate 31 to the flip-flop 33 and decoder 32. Since at this time "1" signals are coupled from the $\overline{Q}$ side output terminals of the flip-flops 29 and 33 to the decoder 32, the decoder 32 produces the signal a, as shown in FIG. 9D, which is supplied to the first and second time table display circuits 5 and 6. With the falling of the one-shot pulse from the one-shot circuit 22, the flip-flop 33 is inverted, so that a "1" signal is supplied as the Q side output of the flip-flop 33, i.e., the time table display signal x, to the display control circuit 9 as shown in FIG. 7. With this time table display signal x supplied to the display control circuit 9, the AND gate 105 is gated, i.e., opened, to couple the time information from the time counting circuit 3 through the OR gate 107 and decoder 108 to the time/calendar display section 14. Thus, the present time is displayed in the time/calendar display section 14 as shown in FIG. 8(*a*). At this time, the time display signal y becomes "0", so that the AND gates 104 and 106 in the display control circuit 9 are closed to disable the coupling of the time information to the time display section 13 and coupling of the calendar information to the time/calendar display section 14.

Meanwhile, with the display switching signal a supplied from the decoder 32 of the input control circuit shown in FIG. 4, in the first time table control circuit 5 shown in FIG. 5 a clock pulse signal $\emptyset_A$ is gated through the AND gate 51 and coupled to the AND gate 71 and flip-flop 56. The flip-flop 56 is set with the falling of this input pulse, whereupon a "1" signal is produced, as shown in FIG. 9F, from its Q side output terminal and coupled to the AND gates 60*a* and 61. The AND gate 71 is opened by the output from the AND gate 51, so that the time information supplied from the time counting circuit 3 is loaded in the address counter 70. The time information loaded in the address counter 70 is read out through the AND gate 77 in synchronism to the clock pulse signal $\emptyset_A$ as shown in FIG. 9A to be coupled to the AND gate 78. Since at this time the output of the flip-flop 56 coupled through the OR gate 80 and a "1" signal from the inverter 79 prevail as respective inputs to the AND gate 78, the address data read out through the AND gate 77 is gated through the AND gate 78 and coupled through the OR gate 81 to the RAM 82. At this time, the RAM 82 is in a read mode since a "1" signal from the inverter 84, inverting a "0" output signal from the AND gate 83, prevails at its read/write terminal R/W. Thus, when the clock pulse signal $\emptyset_C$ as shown in FIG. 9C appears at the enable terminal E of the RAM 82 in this state, the content thereof is read out according to the address data coupled thereto through the OR gate 81. If the time information loaded in the address counter 70 is not contained in the time table memorized in the RAM 82, data "0" is read out from the RAM 82. In this case, no subsequent operation takes place until the next clock pulse $\emptyset_B$ is supplied. The next pulse $\emptyset_B$ supplied is gated, as shown in FIG. 9G, through the AND gate 60*a* to be coupled through the OR gate 69 to the address counter 70. As a result, the content of the address counter 70 is changed by "+1". The resultant content of the address counter 70 is supplied as a new address data through the AND gates 77 and 78 and OR gate 81 to the RAM 82. With the appearance of the next clock pulse $\emptyset_C$, the reading of the content of the RAM 82 is effected according to the new address data. If the content of the address counter 70 at this time is contained in the time table memorized in the RAM 82, data "1" is read out from the RAM 82. This "1" data is read out from the RAM 82 through the AND gate 61 as shown in FIG. 9H and coupled to the three-scale of counter 62 to change the content thereof by "+1". The output of the AND gate 61 is also coupled through the OR gates 95 and 94 to the AND gates 75*a* to 75*c* to open these gates. Thus, the content of the address counter 70 at this time is shifted through the AND gate 75*a* to the latch circuit 73*c*. At the same time, the content of the latch circuit 73*c* is shifted to the latch circuit 73*b*, and the content thereof is shifted to the latch circuit 73*a*. Since the contents of the latch circuits 73*c* and 73*b* are initially "0", this data "0" is latched in the latch circuits 73*b* and 73*a*. Subsequently, every time a clock pulse $\emptyset_B$ is supplied, this signal is coupled as an up-counting signal through the AND gate 60*a* and OR gate 69*a* to the address counter 70, and the content thereof is progressively increased with the up-counting of the input signals coupled thereto. Also, the content of the RAM 82 is read out according to the progressively increasing data content of the address counter 70, and every time "1" is read out from the RAM 82 the content of the address counter 70 at that time is read out to the latch circuit 73*c*, while causing at this time the shift of the previous content of the latch circuit 73*c* to the latch circuit 73*b* and the previous content thereof to the latch circuit 73*a*. When the "1" signal is read out three times from the RAM 82 through the AND gate 61 as shown in FIG. 9H, the three-scale of counter 62 produces a "1" signal as shown in FIG. 9I, so that the flip-flop 56 is reset. In the above operation, three time data items representing respective time instants after the present time are written in the respective latch circuits 73*a* to 73*c*. These time data items stored in the latch circuits 73*a* to 73*c* are supplied to the display control circuit 9 shown in FIG. 7 so that they are supplied through the respective AND gates 101*a* to 101*c* and decoders 103*a* to 103*c* to the first time table display section 15. Likewise, three time data items are supplied from the second time table control circuit 6 to the second time table display section 16. Thus, a time table display as shown in FIG. 8(*a*) can be obtained. In the example shown in FIG. 8(*a*), "7:20" is displayed as the present time in the time/calendar display section 14, "7:27", "7:29" and "7:49" are displayed as respective train departure time data in the first time table display section 15, and "7:26", "7:30" and "7:48" are displayed as respective bus departure time data in the second time table display section 16.

Figure 10:
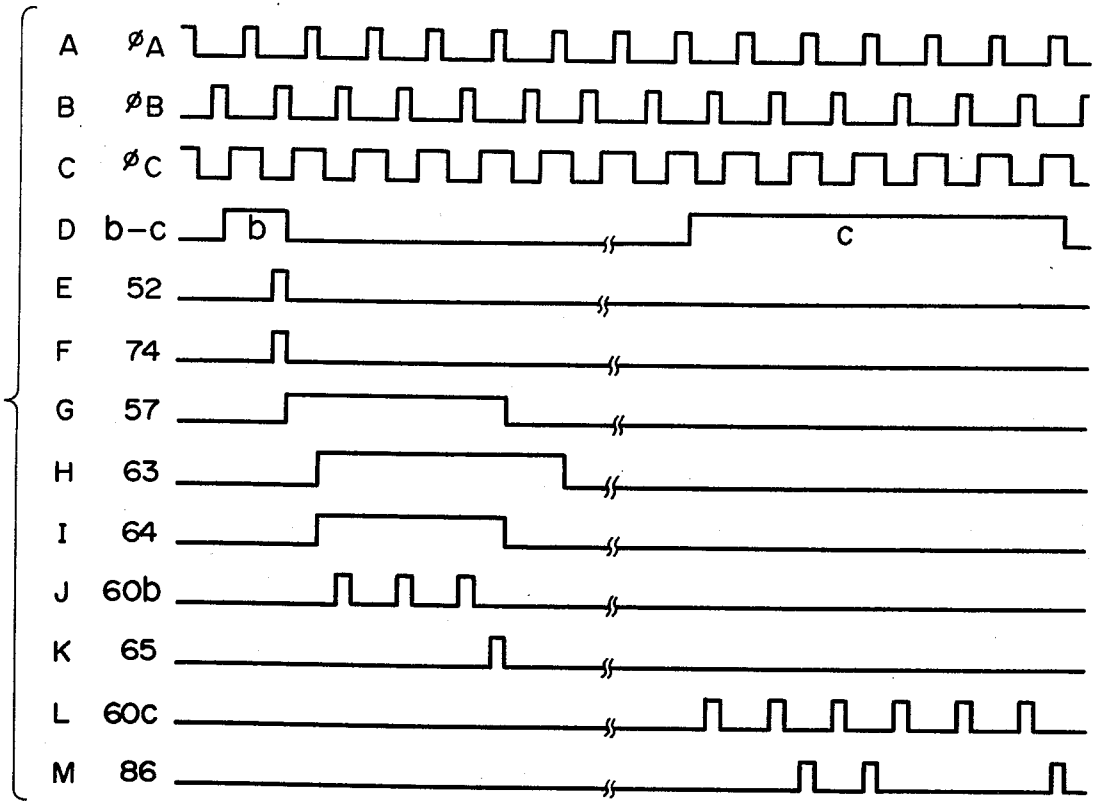
FIGS. 10A to 10M show a time chart illustrating the operation of first time table control circuit 5 in the time table display mode.
Figure 11:
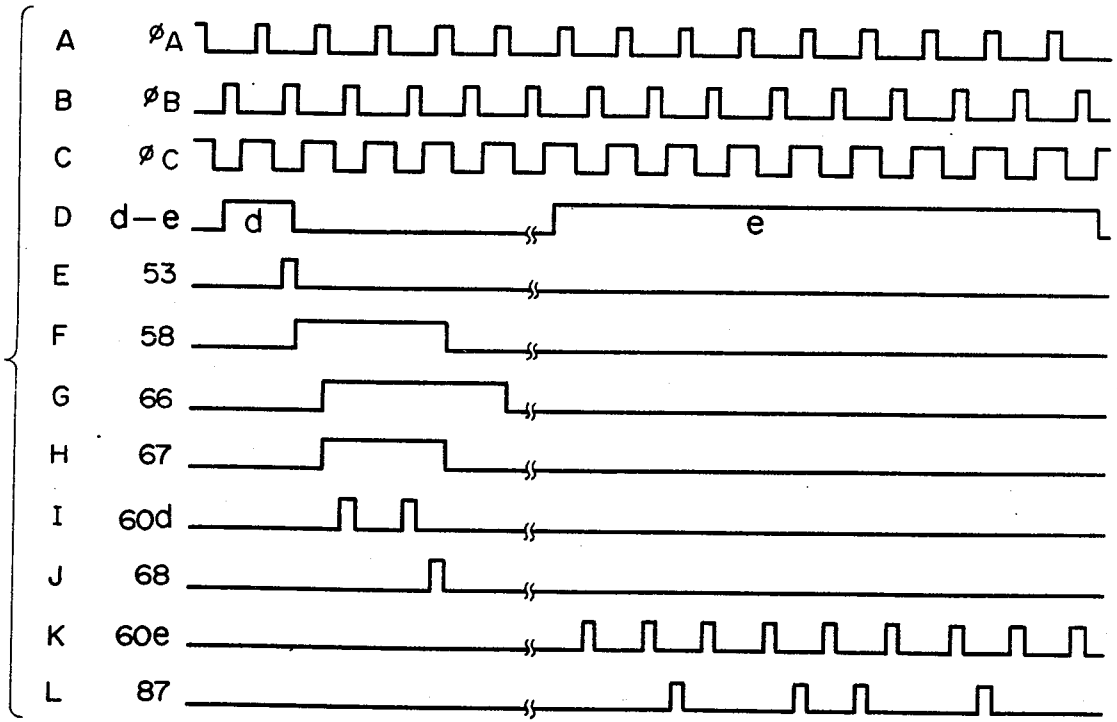
FIGS. 11A to 11L show a time chart illustrating the operation of first time table control circuit 5 at the time of changing displayed data in the time table display mode.

Now, the operation to cause displaying of other time data items memorized as time table data in the memory than those which are displayed as shown in FIG. 8(*a*) will be described. For obtaining the display of time instants later than those displayed in the display sections 15 and 16, the switch $S_3$ is operated. In this case, by depressing the switch $S_3$ intermittently for short periods of time within 3 seconds the time display is changed every time the switch is operated, while by continuously operating the switch $S_3$ for longer than 3 seconds the time display can be continuously changed. In the case when the switch $S_3$ is depressed for a short period of time less than 3 seconds, a one-shot pulse is produced from the one-shot circuit 23 in the input control circuit shown in FIG. 4 and coupled to the AND gate 40. At this time, the flip-flop 39 is in the reset state, with a "1" signal being produced from its $\overline{Q}$ side output terminal and coupled to the AND gate 40. Thus, the output of the one-shot circuit 23 is coupled through the AND gate 40 to the decoder 32. In the normal mode and also when the time table display mode is specified, with the output of the AND gate 40 supplied, the decoder 32 produces the signal b as shown in FIG. 10D. The signal b is supplied to the first and second time table control circuits 5 and 6. In the first time table control circuit 5 shown in FIG. 5, the signal b from the decoder 32 is coupled to the AND gate 52 and gated therethrough in synchronism with the clock pulse signal $\emptyset_B$, as shown in FIG. 10E. The output of the AND gate 52 is coupled through the OR gate 74 to the AND gate 72*d* as shown in FIG. 10F. Thus, the AND gate 72*d* is opened, so that the time data stored in the latch circuit 73*c*, for instance representing 7 o'clock and 49 minutes, is loaded in the address counter 70. The output of the AND gate 52 is also coupled to the flip-flop 57. Thus, the flip-flop 75 is set, whereupon a "1" signal is produced from its Q side output terminal as shown in FIG. 10G and coupled to the AND gate 64 and flip-flop 63. The flip-flop 63 is thus inverted in synchronism with the clock pulse signal $\emptyset_A$, producing a "1" signal from its Q side output terminal as shown in FIG. 10H. The output of the flip-flop 63 is gated through the AND gate 64 as shown in FIG. 10I to be coupled to the AND gate 60*b*. Thus, the next clock pulse $\emptyset_B$ is gated through the AND gate 60*b* as shown in FIG. 10J to be coupled as an up-counting signal through the OR gate 69*a* to the address counter 70. As a result, the content of the address counter 70 is changed by "+1", and the resultant content thereof is coupled in synchronism with the next clock pulse $\emptyset_A$ through the AND gates 77 and 78 and OR gate 81 to an address input terminal A of the RAM 82. Thus, the content of the RAM 82 is read out in synchronism with the clock pulse signal $\emptyset_C$. If the data read out from the RAM 82 is "0", the next clock pulse $\emptyset_B$ is coupled through the AND gate 60*b* and OR gate 69*a* to the address counter 70 to change the content thereof by "+1". The content of the address counter 70 is progressively increased with up-counting of up-counting signals provided in the above manner until data "1" is read out from the RAM 82. When data "1" is read out from the RAM 82, it is coupled through the AND gate 65 as shown in FIG. 10K to reset the flip-flop 57. The output of the AND gate 65 is also coupled through the OR gates 95 and 94 to the AND gates 75*a* to 75*d*. Thus, the AND gates 75*a* to 75*c* are opened to cause a shift of the content of the address counter 70 to the latch circuit 73*c*, the content thereof to the latch circuit 73*b* and the content thereof to the latch circuit 73*a*. Through the above operation, time data representing a time instant after the latest time instant displayed is latched in the latch circuit 73*c*. Also, the data $A_1$ to $C_1$ latched in the respective latch circuits 73*a* to 73*c* at this time are supplied to the first time table display section 15 and displayed therein as shown in (b) in FIG. 8. In the second time table control circuit 6, similar operation to that in the circuit 5 takes place, and the resultant shifted time data are supplied to the second time table display section 16 and displayed therein as shown in (b) in FIG. 8. In the above way, the displayed time table data are successively shifted every time the operation of switch $S_3$ is repeated, for instance as shown in (c) in FIG. 8.

In the case when the switch $S_3$ is continuously depressed for longer than 3 seconds, the decoder 32 again produces the signal b in the manner as described above, and also the output from the switch $S_3$ shown in FIG. 4 is coupled through the OR gate 34 to the AND gate 35 to open this AND gate. Thus, the one-second signal 1P/S is coupled through the AND gate 35 to the three-scale of counter 37. The content of the counter 37 is thus progressively increased with the up-counting of the signal 1P/S. When it counts three pulses of the one-second signal 1P/S, the counter 37 produces a carry signal which is coupled to the AND gate 38 to open this gate. Thus, the flip-flop 39 is set by the clock pulse $\emptyset_A$ coupled through the AND gate 38 and produces a "1" signal from its Q side output terminal, thus opening the AND gate 41 so that the output of the switch $S_3$ is coupled through the AND gate 41 to the decoder 32. With the decoder 32 in the normal mode and also in the time table display mode, when the "1" signal is coupled from the AND gate 41 it produces the signal c as shown in FIG. 10D. In the first time table control circuit 5 shown in FIG. 5, with the signal c supplied from the decoder 32 the AND gate 60*c* is opened, so that subsequent clock pulses $\emptyset_B$ are coupled through the AND gate 60*c* as shown in FIG. 10L. The address counter 70 thus up-counts the output of the AND gate 60*c* coupled to it through the OR gate 69*a*, so that its content progressively increases. The content of the RAM 82 is read out according to the content of the address counter 70 as mentioned earlier. When "1" is read out from the RAM 82, a "1" signal is produced from the AND gate 86 as shown in FIG. 10M to be coupled through the OR gates 95 and 94 to the AND gates 75*a* and 75*c*. Thus, the content of the address counter 70 is read out to the latch circuit 73*c*, while the contents of the latch circuits 73*c* and 73*b* are shifted to the respective latch circuits 73*b* and 73*a*. This operation is repeatedly brought about while the switch $S_3$ is being depressed. When the switch $S_3$ is released, i.e., opened, the counter 37 in the input control circuit 8 is reset, while at the same time the output signal c from the decoder 32 is inverted to "0" to bring an end to the up-counting operation of the address counter 70 in the first time table control circuit 5. At this time, the data $A_1$ to $C_1$ stored in the latch circuits 73*a* to 73*c* are displayed in the first time table display section 15.

While the operation that takes place when causing the display of data representing time instants later than those displayed as time tables has been described, for causing the display of time instants earlier than those displayed the switch $S_4$ is operated, whereby similar display control can be obtained. Examples of the shift of the time table display from that shown in (a) in FIG. 8, caused by operating the switch $S_4$, are shown in (d) and (e) in FIG. 8. FIGS. 11A to 11L show a timing chart for the case when the switch $S_4$ is operated, and the detailed description of the operation in this case is omitted.

Figure 12:
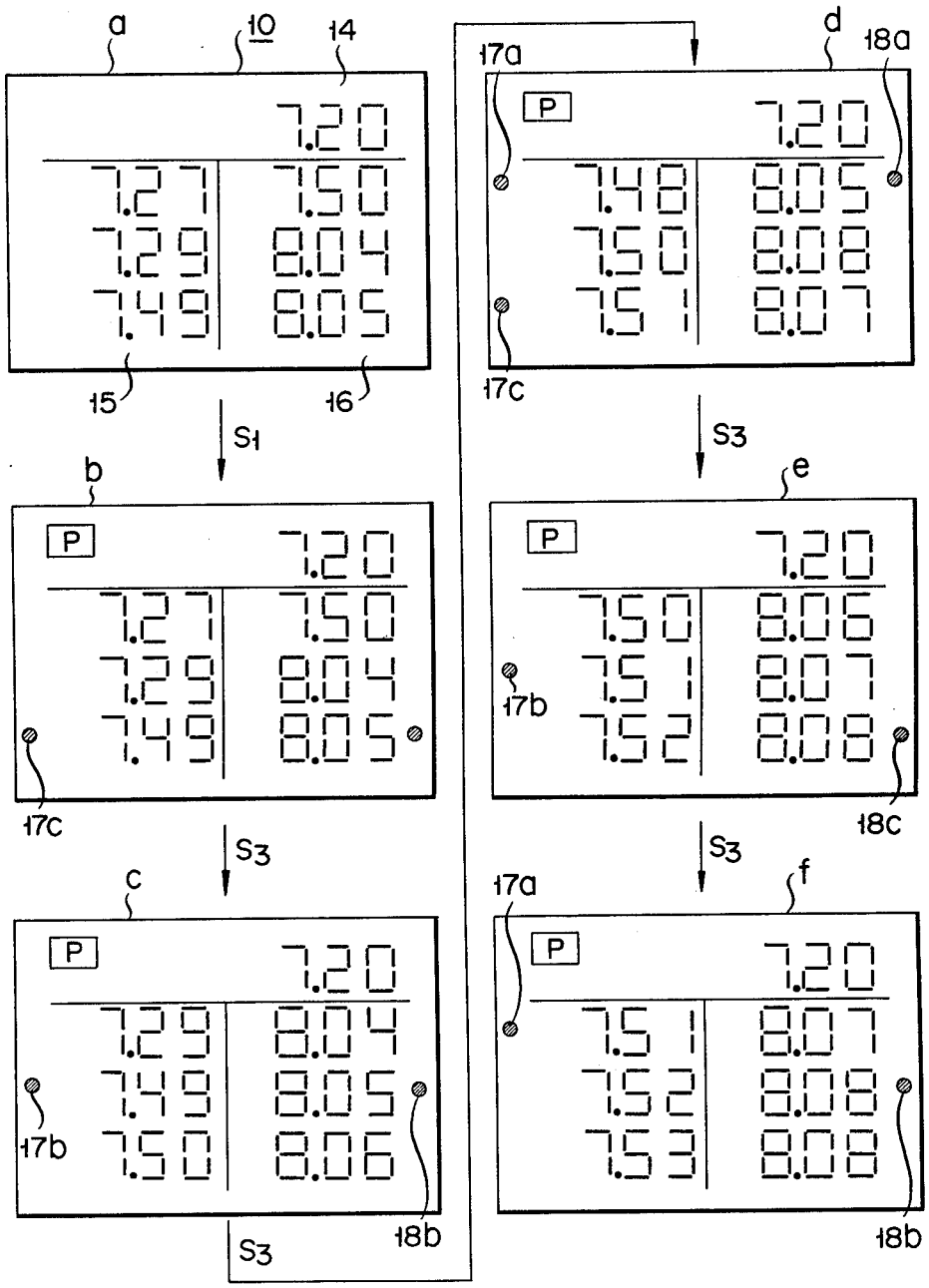
FIG. 12 shows examples of the display in the display unit 10 in presetting mode.
Figure 13:
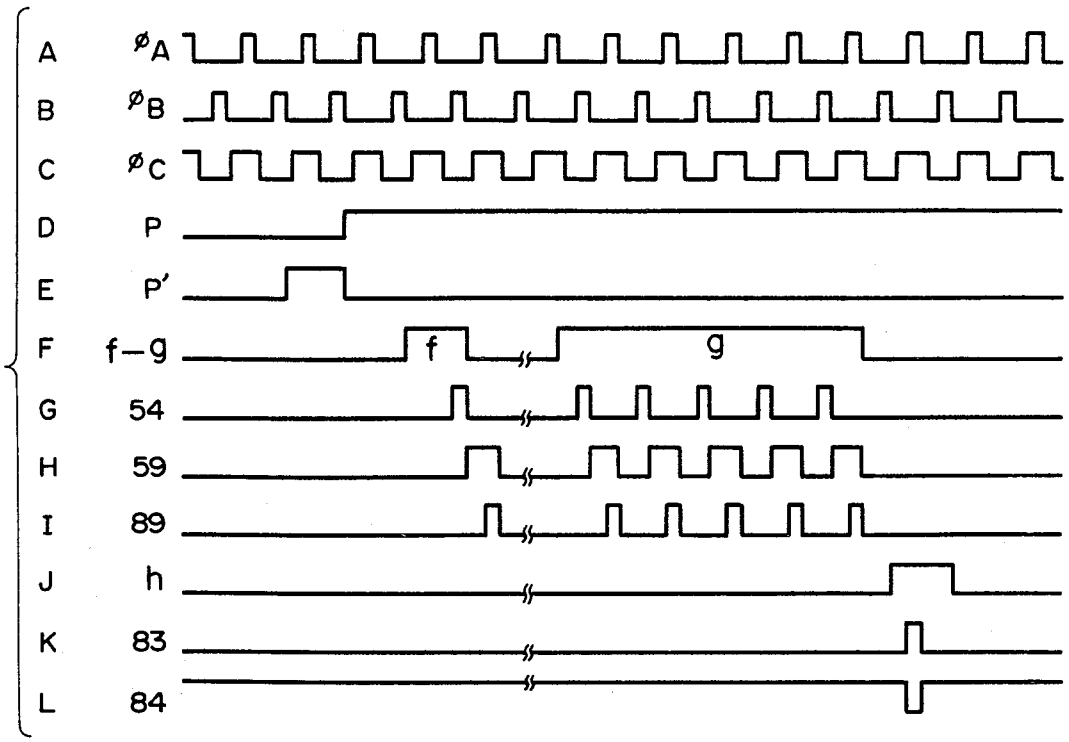
FIGS. 13A to 13L show a time chart illustrating the operation of first time table control circuit 5 in the presetting mode.

Now, the operation for correcting the time table data memorized in the RAM 82 will be described. In this case, the presetting mode is set by operating the switch $S_2$ when the system is in a state in which time table data, for instance as shown in (a) in FIG. 12, are displayed. When the switch $S_1$ is operated, a one-shot pulse is produced from the one-shot circuit 21 in synchronism with the clock pulse signal $\emptyset_B$. This one-shot pulse is supplied as presetting mode signal P' through the AND gate 27 to the first and second control circuits 5 and 6 as shown in FIG. 13E. It is also coupled through the AND gate 28 to the flip-flop 29 for causing the inversion thereof at the time of its falling. With this inversion, the presetting mode signal P as shown in FIG. 13D is produced from the Q side output terminal of the flip-flop 29 and supplied to the first and second control circuits 5 and 6, display control circuit 9 and display unit 10. In the display unit 10, the "P" display electrode is driven by the presetting mode signal P. Thus, the presetting mode is displayed, as shown in FIG. 7 and in (b) in FIG. 12. Meanwhile, in the first time table control circuit 5 as shown in FIG. 5, the AND gate 72*d* is opened by the presetting signal P', so that the data stored in the latch circuit 73*c*, for instance data representing 7 o'clock and 49 minutes, is loaded to the address counter 70. When the presetting mode signal P appears at the AND gate 76, the data loaded in the address counter 70 is coupled through the AND gate 76 and OR gate 81 to the address input terminal A of the RAM 82. Thus, the content of the RAM 82 is read out in synchronism with the clock pulse signal $\emptyset_C$ according to this address data. The data read out from the RAM 82 is "1" at this time, and it is coupled through the AND gate 85 which is held open by the presetting mode signal P to the latch circuit 97*c* to be latched therein. This latched data $C_0$ in the latch circuit 97 is supplied to the display control circuit 9 shown in FIG. 7 to be coupled to the AND gate 102*c*. Since the presetting mode signal P prevails at the AND gate 102*c* at this time, the output signal $C_0$ from the latch circuit 97*c* is gated through the AND gate 102*c*. By this output of the AND gate 102*c* the presetting display electrode 17*c* in the first time table display section 15 is driven as shown in (b) in FIG. 12, indicating that the time instant data "7:49" displayed in the lowest position in the first time table display section 15 has been preset. In the second time table display section 16, the presetting display electrode 18*c* is similarly driven to indicate that the time instant displayed in the lowest position has been preset. At this time, the presetting of the time instants displayed in the lowest position in the display sections 15 and 16 and releasing of the preset time instants in the display are effected. This is done with the switches $S_5$ and $S_6$. When the switches $S_5$ and $S_6$ are operated in the display state of the presetting display electrodes 17*c* and 18*c*, the presetting of the displayed time instants is effected. On the other hand, when these switches are operated in the non-display state of the presetting display electrodes, the preset time instants in the display are released.

For shifting the displayed time data, for instance as shown in (b) in FIG. 12, to a later time display, the switch $S_3$ is operated as mentioned earlier. With the operation of the switch $S_3$ a one-shot pulse is produced from the one-shot circuit 23 and coupled through the AND gate 40 to the decoder 32. When time table data are displayed and also in the presetting mode, with the output of the AND gate 40 coupled to the decoder 32, the signal f is produced as shown in FIG. 13F. In the first time table display circuit 5, the signal f is coupled through the OR gate 55 to the AND gate 54 to open this AND gate so that the clock pulse signal $\emptyset_B$ is gated through the AND gate 54 as shown in FIG. 13G. The output of the AND gate 54 is coupled through the OR gate 69*a* to the address counter 70 to change the content thereof by "+1". Also, with the falling of the output signal from the AND circuit 54 the flip-flop 59 is set to produce a "1" signal from its Q side output terminal as shown in FIG. 13H. With this output of the flip-flop 59 the AND gate 89 is opened, so that the clock pulse signal $\emptyset_A$ is gated through the AND gate 89 as shown in FIG. 13I. The output from the AND gate 89 is coupled through the OR gate 94 to the AND gates 75*a* to 75*c*, thus opening these AND gates to cause a shift of the contents of the address counter 70 and latch circuits 73*c* and 73*b* to the respective latch circuits 73*c*, 73*b* and 73*a*. Also, with the output of the AND gate 89, the AND gates 93 and 92 are opened to cause a shift of the contents of the latch circuits 96*c* and 97*b* to the respective latch circuits 97*b* and 97*a*. The data latched in the latch circuits 97*a* to 97*c* and 73*a* to 73*c* are transferred through the display control circuit 9 to the display unit 10 for display as shown in (c) in FIG. 12. In the above way, every time the switch $S_3$ is operated, the displayed data in the display sections 15 and 16 are shifted to the next upper position, while time data representing the time instant of the lowest shifted data plus "+1" minute is displayed in the lowest position. That is, the display shown in (c) in FIG. 12 is shifted to that shown in (d) in FIG. 12 with the operation of the switch $S_3$. In the case when the switch $S_3$ is continuously operated for longer than 3 seconds, the displayed data in the display sections 15 and 16 are continuously shifted upwards while time data representing the time instant of each lowest shifted data plus "+1" minute is successively displayed in the lowest position. When it is desired to preset the time data displayed in the lowest position in the first time table display section 15, for instance data representing 7 o'clock and 51 minutes as shown in (d) in FIG. 12, the switch $S_5$ is operated in this display state. As a result, a one-shot pulse is produced from the one-shot circuit 25 shown in FIG. 4 and coupled to the decoder 32. With the output of the one-shot circuit 25 coupled to it, the decoder 32 produces the signal h as shown in FIG. 13J. In the first time table control circuit 5, with the signal h supplied from the decoder 32 the AND gate 83 is opened, so that a clock pulse $\emptyset_A$ is gated through the AND gate 83 as shown in FIG. 13K to be coupled to the latch circuit 97*c* and latched therein. Also, when the output of the AND gate 83 becomes "1", the output of the inverter 84 is inverted to "0" as shown in FIG. 13L, so that the RAM 82 is switched from the read mode over to the write mode. At this time, the content of the RAM 82 in the specified address is "0", and this data "0" has been written in the flip-flop 88 at the time of the read mode. Thus, when the RAM 82 is switched to the write mode, the data "0" in the flip-flop 88 is coupled after inversion through the inverter 91 to "1" to the data input terminal $D_{IN}$ of the RAM 82, so that "1" is written in the specified address of the RAM 82, i.e., the address corresponding to "7:51". Meanwhile, the data "1" latched in the latch circuit 97*c*, i.e., data $C_0$, is supplied to the display control circuit 9 and then supplied through the AND gate 102*c* to the first time table display section 15. Thus, the setting display electrode 17*c* in the display section 15 is driven to indicate that the time data representing "7:51" is preset in the RAM 82. The presetting of time data in the second time table display section 16 and display thereof may be similarly obtained by operating the switch $S_6$. Shown in (e) in FIG. 12 is the state of display when time data "8:08" is preset. When the switch $S_3$ is operated in the display state shown in (e) in FIG. 12, the display is shifted by "one minute" as shown in (f) in FIG. 12. Thus, it will be understood that desired time instants can be preset by appropriately operating the switches $S_3$ and switches $S_5$ and $S_6$. The releasing of a preset time data is effected by operating the switch $S_5$ or $S_6$ when that data is displayed in the lowest position in the display section 15 or 16. When the presetting of time data is being made, the flip-flop 88 is set and is producing from its Q side output terminal a "1" signal, which is coupled after inversion through the inverter 91 to "0" to the data input terminal $D_{IN}$ of the RAM 82. Thus, with the operation of the switch $S_5$ the "0" signal is written in the specified address of the RAM 82, and the preset time data is released.

While in the above embodiment the time table data displayed are shifted once by operating the switches $S_3$ and $S_4$ once, it is possible to arrange the system such that the time table data displayed are shifted three times, i.e., they are entirely altered, by operating the switches $S_3$ and $S_4$ once.

Also, while in the above embodiments time data for time instants spaced apart by one minute are successively displayed so that the displayed time instant may be memorized in the memory, the interval between adjacent time instants displayed need not be one minute and can be varied to two minutes, five minutes and so forth if desired. Further, it is possible to permit such time data as "month" and "day" data and "day" and "hour" data to be memorized. In this case, the time data may be successively displayed at an interval of one day or one hour.

Furthermore, while in the above embodiment time tables are memorized, it is possible to memorize any successive time data such as successive alarm time instants.

Further, while in the above embodiment train and bus departure time data are memorized, it is possible to memorize and simultaneously display schedules for two persons. Further, in the case of displaying time table data the displays in the first and second display sections need not be based upon the same reference time. For example, in case where one has to be in a train for 30 minutes before changing to a bus, time data based upon the present time may be displayed in the first time table and time data based upon a time instant 30 minutes later may be displayed in the second time table.

Figure 14:
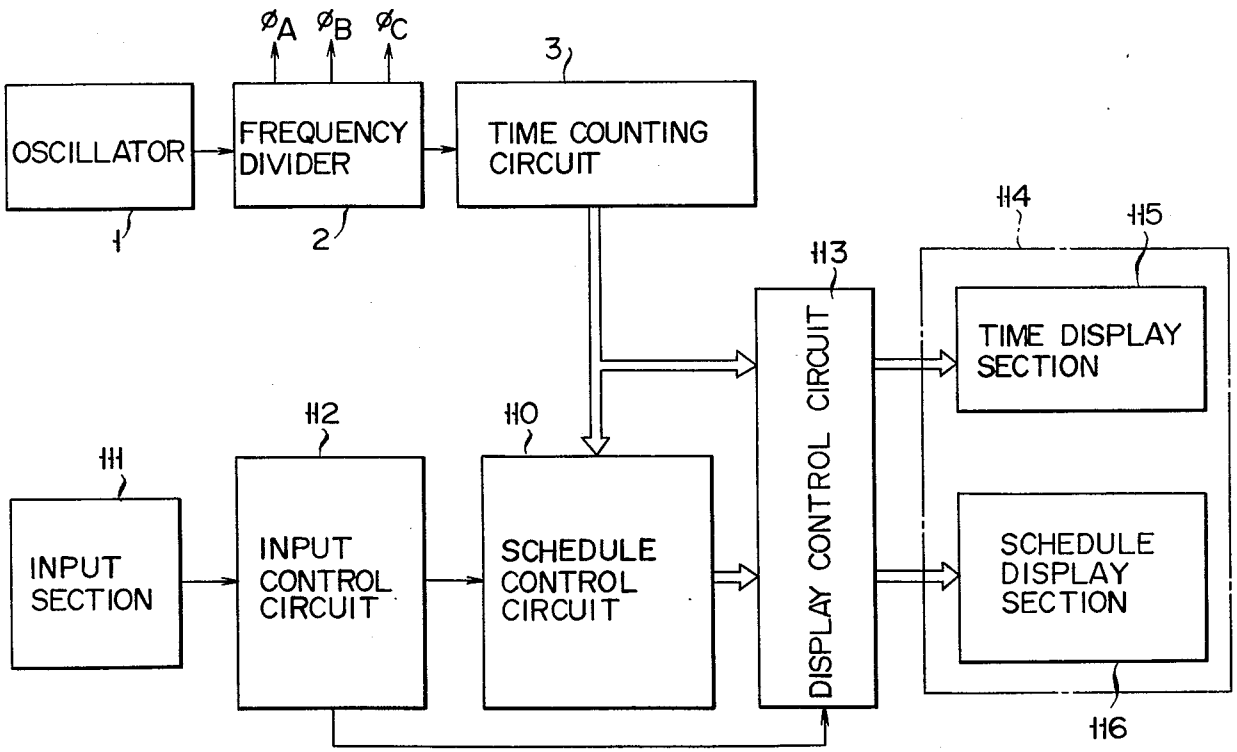
FIG. 14 is a block diagram showing a different embodiment of the invention.

FIG. 14 shows a different embodiment of the invention. In the Figure, parts corresponding to those in FIG. 1 are designated by like reference numerals, and their description is omitted.

In FIG. 14, designated at 110 is a schedule display control circuit. It includes an internal memory for memorizing a schedule and has a function of reading and writing data. Schedule data read out from the internal memory according to an instruction given from an input section 111 through an input control circuit 112 is supplied to a display control circuit 113. The display control circuit 113 selectively transfers information from the time counting circuit 3 and schedule control circuit 110 to a display unit 114 according to a selection signal from the input control circuit 112. The display unit 114 includes two liquid crystal display devices overlapped over one another and respectively constituting upper and lower display sections 115 and 116. The upper display section 115 is a time display section, and the lower display section 116 is a schedule display section.

Figure 15A:
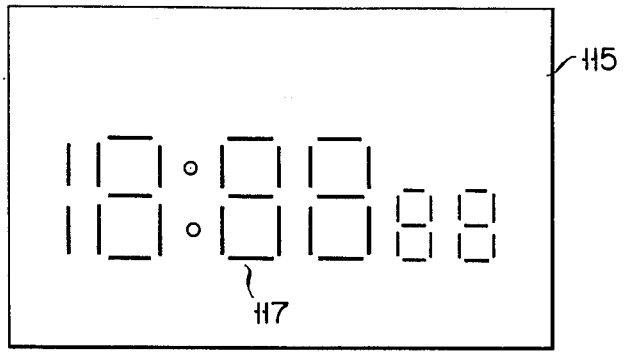
FIGS. 15A to 15C are views respectively showing upper and lower display sections 115 and 116 and transparent plate 121 in display unit 114 shown in FIG. 14.
Figure 15B:
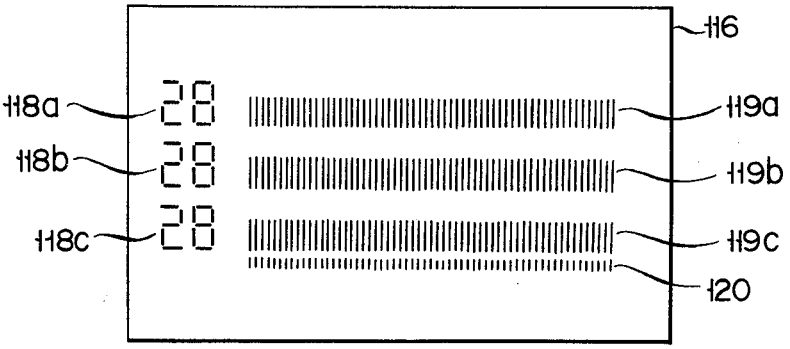
Figure 15C:
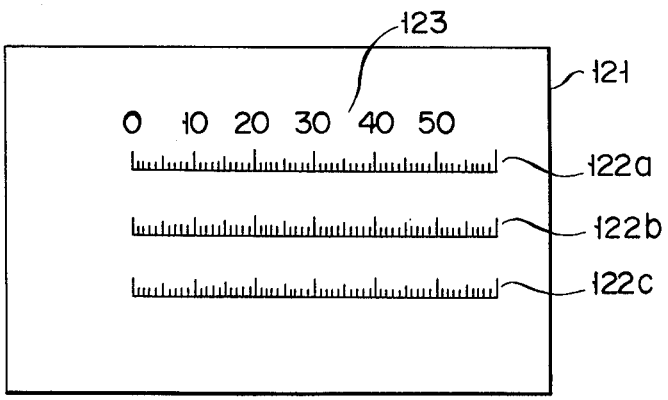

As shown in FIG. 15A, the time display section 115 has six digits of display electrodes 117 for digitally displaying "hour", "minute" and "second" data. The schedule display section 116 has a construction as shown in FIG. 15B. More particularly, it has three "hour" display electrode sets 118*a* to 118*c* arranged in a column at the left hand end for digitally displaying "hour" data. It also has analog display electrode sets 119*a* to 119*c* individually provided on the right side of the respective "hour" display electrode sets 118*a* to 118*c* for analog display of "minute" data. These analog display electrode sets 119*a* to 119*c* each consist of 60 parallel bar electrodes arranged in a row at a predetermined interval so that "minute" data can be displayed analog-wise. Under the lowest analog display electrode set 119*c*, sixty data setting electrodes 20 are provided to correspond to the respective bar electrodes in the individual analog display electrode sets. The display unit 114 further includes a transparent plate 121 as shown in FIG. 15*c*, which is placed on the stack of the upper and lower display devices, namely time display section 115 and schedule display section 116. It has an impression of scales 122*a* to 122*c* corresponding to the respective analog display electrode sets 119*a* to 119*c* and also figure marks "0", "10", . . . , "50", designated at 23, above these scales at an interval of 10 graduations from the left end. Thus, when the analog display electrode sets 119*a* to 119*c* are driven for display, the display position can be instantly read out from the relevant graduation and figure marks.

Figure 16:
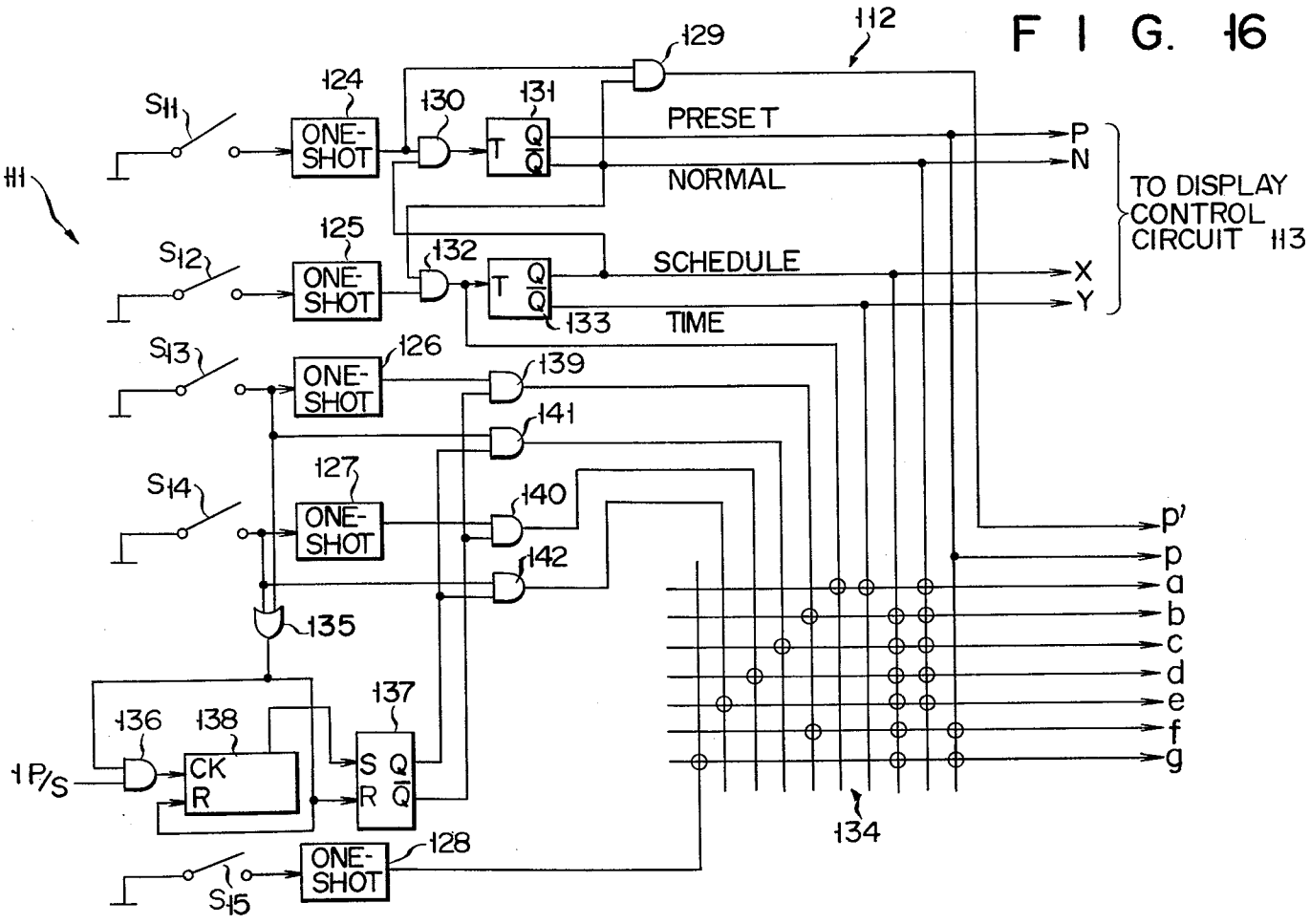
FIG. 16 is a schematic showing switch section 111 and input control circuit 112 shown in FIG. 14.

FIG. 16 shows the input section 111 and input control circuit 112 in detail. The input section 111 has a switch $S_{11}$ for switching presetting and normal modes, a switch $S_{12}$ for switching time display and schedule display modes, a switch $S_{13}$ for effecting a "+1" operation, a switch $S_{14}$ for effecting a "−1" operation and a switch $S_{15}$ for specifying schedule display. The outputs produced from the switches $S_{11}$ to $S_{15}$ when these switches are operated are coupled to respective one-shot circuits 124 to 128. The output of the one-shot circuit 124 is coupled to an AND gate 129 and also coupled through an AND gate 130 to a trigger terminal T of a T-type flip-flop 131. The $\overline{Q}$ side and Q side outputs of the flip-flop 131 are supplied respectively as a normal mode signal N and a presetting mode signal P to the display control circuit 113. The $\overline{Q}$ side output of this flip-flop is also coupled to the AND gate 129 and to an AND gate 132 and a decoder 134. The output of the one-shot circuit 125 is coupled to the AND gate 132, and the output thereof is coupled to a trigger terminal T of a T-type flip-flop 133. The $\overline{Q}$ side and Q side outputs of the flip-flop 133 are supplied respectively as a time display signal y and a schedule display signal x to the display control circuit 113. The $\overline{Q}$ side output of this flip-flop is also coupled to the decoder 134, and the Q side output of the flip-flop is coupled to the AND gate 130 and decoder 134. The outputs of the switches $S_{13}$ and $S_{14}$, which are coupled to the respective one-shot circuits 126 and 127 as mentioned earlier, are also coupled through an OR gate 135 to an AND gate 136. It is further coupled to a reset terminal R of a flip-flop 137 and a reset terminal R of a three-scale of counter 138. The output of frequency divider 2 is a one-second signal 1P/S, and the output thereof is coupled to a clock input terminal CK of the counter 138. The carry output of the counter 138 is coupled to a set terminal S of the flip-flop 137. The $\overline{Q}$ side output of the flip-flop 137 is coupled to AND gates 139 and 140, and the Q side output of this flip-flop is coupled to AND gates 141 and 142. The one-shot pulse outputs of the one-shot circuits 126 and 127 are coupled to the respective AND gates 139 and 140, and the outputs of the switches $S_{13}$ and $S_{14}$ are coupled to the respective AND gates 141 and 142. The outputs of the AND gates 139 and 142 are coupled to the decoder 134. The one-shot pulse output of the one-shot circuit 128 is coupled to the decoder 134 comprises AND gates and produces control commands a to g according to the operation of the switches $S_{11}$ to $S_{15}$. These output signals a to g of the decoder 134, Q side output P of the flip-flop 137 and output P' of the AND gate 129 are supplied to the schedule control circuit 110.

Figure 17A:
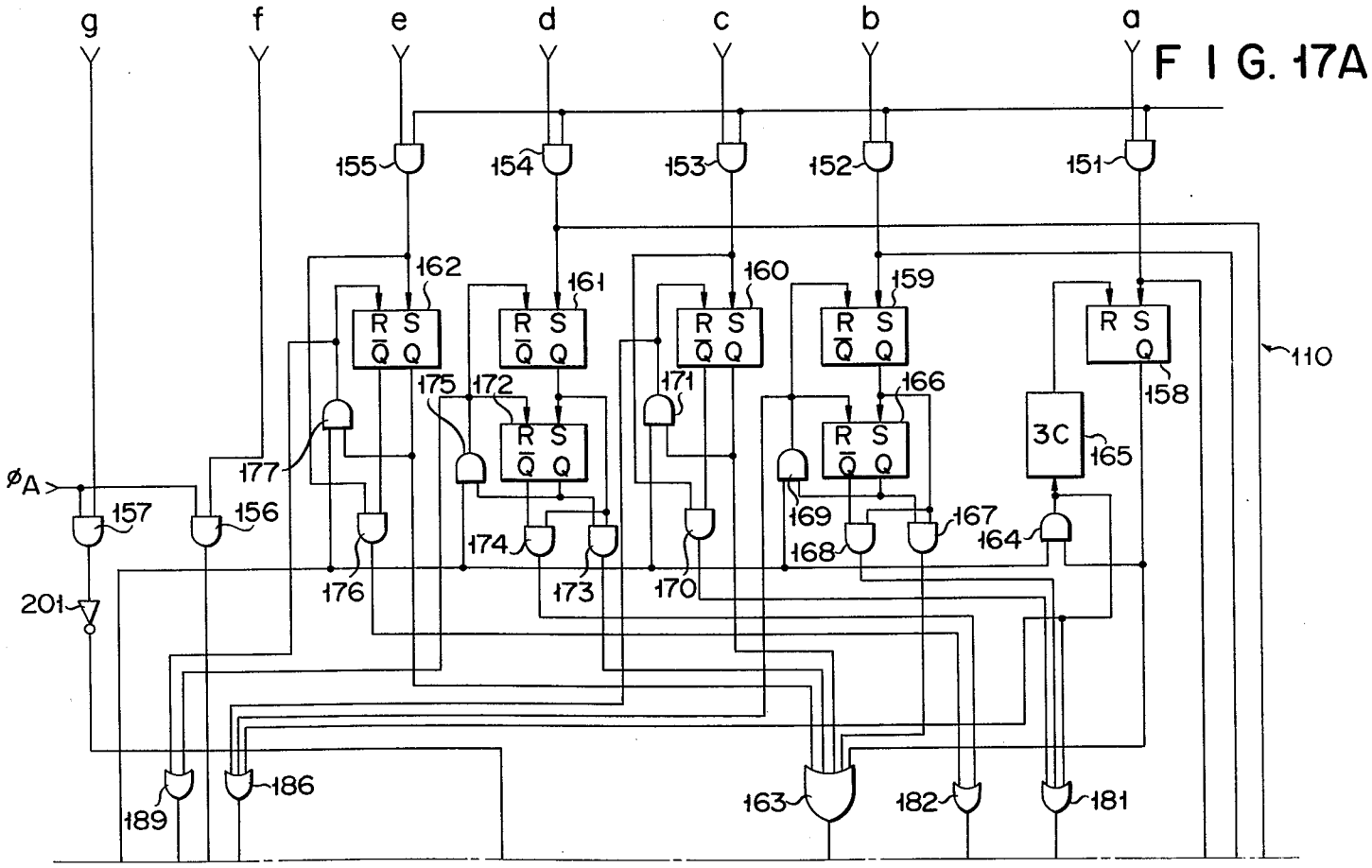
FIGS. 17A and 17B, which constitute
Figure 17B:
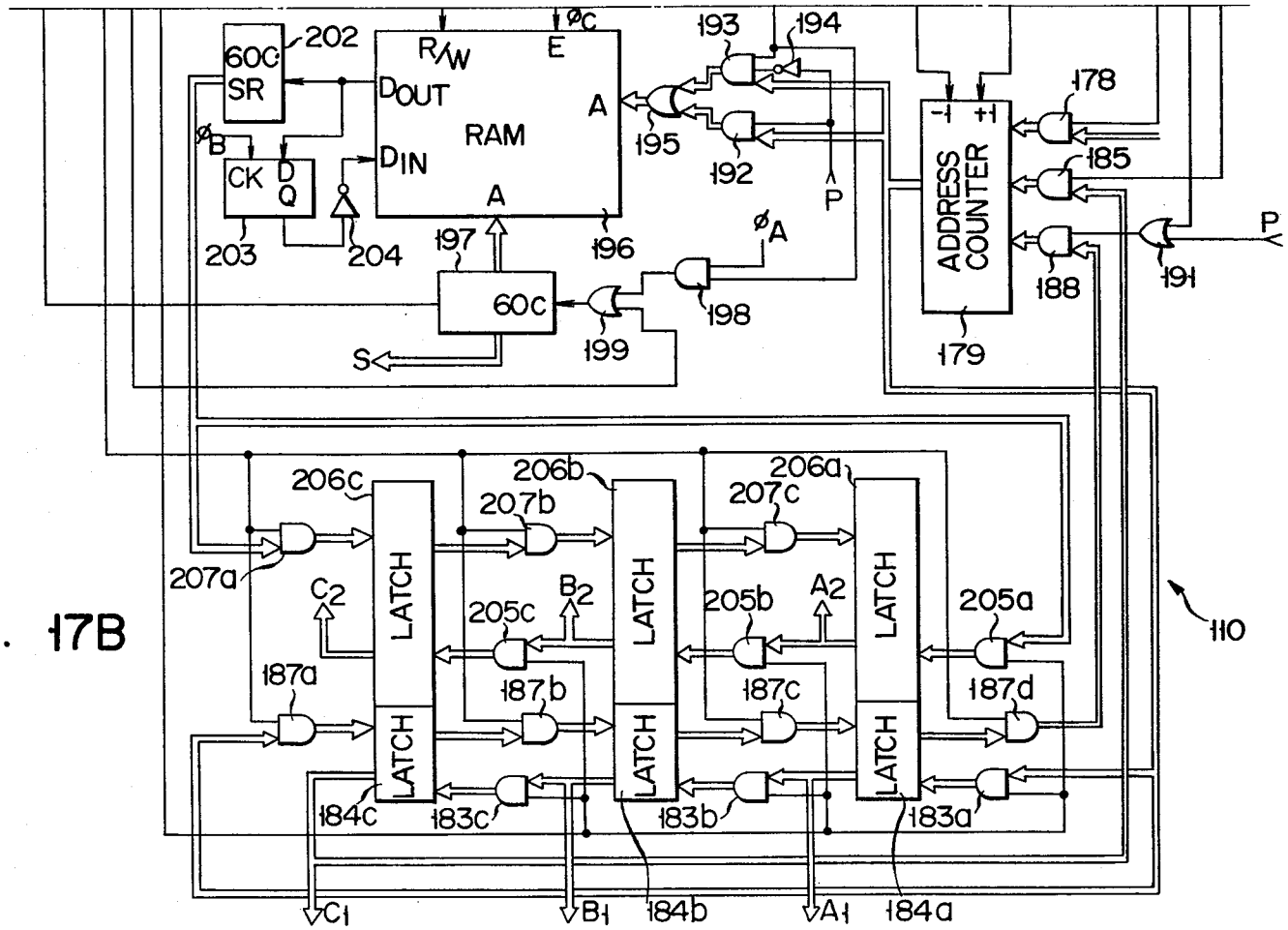

FIG. 17, consisting of FIGS. 17A and 17B, shows in detail the schedule control circuit 110, which will now be described. In the Figure, the output signals a to e from the decoder 134 in the input control circuit 112 shown in FIG. 16 are coupled to respective AND gates 151 to 155. The output signals f to g of the decoder 134 are coupled to respective AND gates 156 and 157. The clock pulse signal $\emptyset_B$ from the aforementioned frequency divider 2 is coupled to the AND gates 151 to 155, and the clock pulse signal $\emptyset_A$ is coupled to the AND gates 156 and 157. The outputs of the AND gates 151 to 155 are coupled to set terminals S of respective S-R flip-flops 158 to 162. The output of the flip-flop 158 is coupled to an OR gate 163 and also coupled through an AND gate 164 to a three-scale of counter 165. The flip-flop 158 is set by the output of the counter 165. The output of the flip-flop 159 is coupled to an input terminal S of an S-R flip-flop 166 and also to AND gates 167 and 168. The Q side and $\overline{Q}$ side outputs of the flip-flop 166 are coupled to the respective AND gates 167 and 168. The Q side output of the flip-flop 166 is also coupled through an AND gate 169 to reset terminals R of the flip-flops 159 and 166. The $\overline{Q}$ side output of the flip-flop 70 and output of the AND gate 153 are coupled to an AND gate 170, and the Q side output of this flip-flop is coupled through an AND gate 171 to a reset terminal R of its own. The Q side output of the flip-flop 161 is coupled to a set terminal S of the flip-flop 172 and also the AND gates 173 and 174. The $\overline{Q}$ side output of the flip-flop 172 is coupled to the AND gate 174, and the Q side output of this flip-flop is coupled to the AND gate 173 and also coupled through an AND gate 175 to reset terminals R of the flip-flops 161 and 172. The $\overline{Q}$ side output of the flip-flop 162 is coupled to an AND gate 176, which also receives the output of the AND gate 155, and the Q side output of this flip-flop is coupled through an AND gate 177 to a reset terminal R of its own.

The output of the AND gate 151 is coupled as a gating signal to an AND gate 178. To the AND gate 178 is supplied time information from time counting circuit 3 shown in FIG. 4, and this time information is loaded in an address counter 179 when the AND gate 178 is opened by the output of the AND gate 151. The outputs of the AND gates 164, 168 and 170 are coupled "+1" signal through an OR gate 181 to the address counter 179, and the outputs of the AND gates 174 and 176 are coupled as a "−1" signal through an OR gate 182 to the counter 179. The output of the address counter 179 is coupled through an AND gate 183*a* to a latch circuit 184*a*. The time information latched in the latch circuit 184*a* is progressively shifted through an AND gate 183*b* to a latch circuit 184*b* and then through an AND gate 183*c* to a latch circuit 184*c*. The time data shifted to the latch circuit 184*c* is transferred through an AND gate 185 to the address counter 179. The AND gates 183*a* to 183*c* are controlled for gating by the output of an OR gate 186, to which the outputs of the AND gates 164, 169 and 171 are coupled, and the AND gate 185 is controlled for gating by the output of the AND gate 154. The content of the address counter 179 is also coupled through an AND gate 187*a* to the latch circuit 184*c*. The data latched in the latch circuit 184*c* is progressively shifted through an AND gate 187*b* to the latch circuit 184*b* and then through an AND gate 187*c* to the latch circuit 184*a*. The time data in the latch circuit 184*a* is transferred through AND gates 187*d* and 188 to the address counter 179. At this time, the AND gates 187*a* to 187*d* are controlled for gating by the output of an OR gate 189, to which the outputs of the AND gates 175 and 177 are coupled. The AND gate 188 is controlled for gating by the output of an OR gate 191, which receives the output of the AND gate 152 and the signal P supplied as presetting signal from the input control circuit 112. The content of the address counter 179 is further coupled to AND gates 192 and 193. The presetting signal P is coupled directly to the AND gate 192, while it is coupled after inversion through an inverter 194 to the AND gate 193. The Q side outputs of the flip-flops 158, 160 and 162 and the outputs of the AND gates 167 and 173 are coupled through the OR gate 163 to the AND gate 193. The outputs of the AND gates 192 and 193 are coupled as address data through an OR gate 195 to a random access memory (RAM) 196. The RAM 196 memorizes a schedule and has, for instance, $24\times60=1,440$ sets of memory elements so that it can memorize time data for 24 hours at an internal of one minute in addresses specified by the address data coupled from the OR gate 195 and an address counter 197. More particularly, in the RAM 196 "0 to 23 o'clock" hour zones are specified by 5-bit column address data from the OR gate 195, and minute zones in the individual hour zones are specified by 6-bit row address data from the address counter 197. The presence and absence of time data for time instants spaced apart at an interval of one minute, namely from "0:00" through "23:59", are written in terms of "1" and "0" in corresponding addresses in the RAM 196. The address counter 197 receives an up-counting signal the output of an OR gate 199, which receives the output of an AND gate 198 receiving the output of the OR gate 163 and the clock pulse signal $\emptyset_A$ and also receives the output of the AND gate 156. The output data S of the address counter 197 is supplied to the display control circuit 113, and the carry output of this counter is coupled to the AND gates 164, 169, 171, 175 and 177. The clock pulse signal $\emptyset_C$ is supplied to an enable terminal E of the RAM 196, and the output of the AND gate 157 is coupled through an inverter 201 to a read/write terminal R/W of the RAM. The RAM 196 is in a read mode when a "1" signal prevails at the read/write terminal W/R while it is in a write mode when a "0" signal prevails at the terminal W/R. The data read out from the RAM 196 is coupled to a 60-step shift register 202 and also to a data input terminal D of a D-type flip-flop 203. The clock pulse signal $\emptyset_B$ is coupled to a clock input terminal CK of the flip-flop 203, and the Q side output thereof is coupled to a data input terminal $D_{IN}$ of the RAM 196. The content of the shift register 202 is coupled through an AND gate 205*a* to a minute data latch circuit 206*a* and latched therein. The minute data latched in the latch circuit 206*a* is progressively shifted through an AND gate 205*b* to a minute data latch circuit 206*b* and then through an AND gate 205*c* to a minute data latch circuit 206*c*. The AND gates 205*a* to 205*c* are controlled for gating by the output of the OR gate 186. The content of the shift register 202 is also coupled through an AND gate 207*a* to the latch circuit 206*c* and latched therein. The minute data latched in the latch circuit 206*c* is progressively shifted through an AND gate 207*b* to the latch circuit 206*b* and then through an AND gate 207*c* to 206*a*. The AND gates 207*a* to 207*c* are controlled for gating by the output of the OR gate 189. The time data $A_1$ to $C_1$ in the respective latch circuits 184*a* to 184*c* and minute data $A_2$ to $C_2$ in the respective latch circuits 206*a* to 206*c* are supplied as display data to the display control circuit 113.

Figure 18:
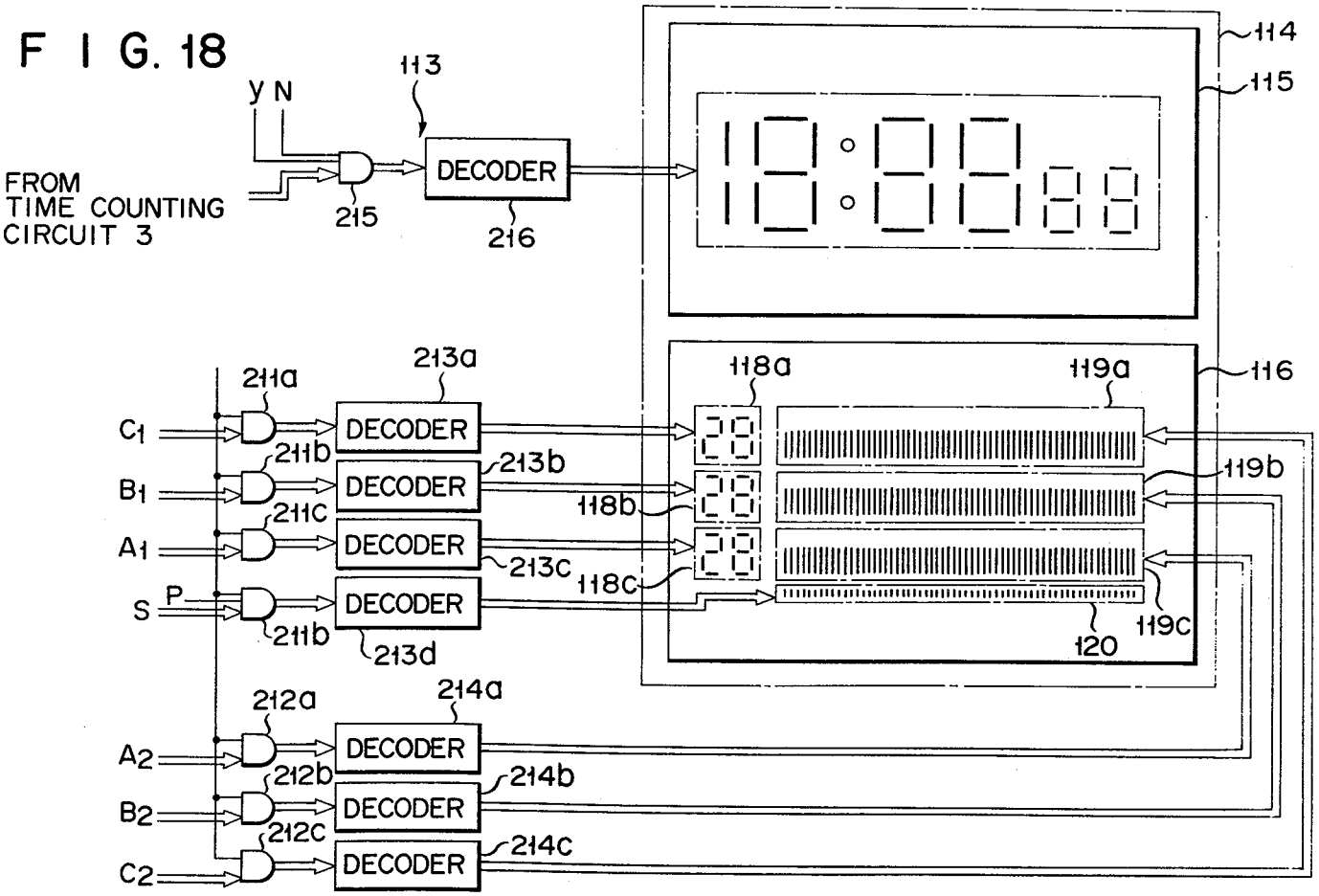
FIG. 18 is a schematic showing display control circuit 113 and display unit 114 shown in FIG. 14.

FIG. 18 shows the detailed construction of the display control circuit 113. The time data $A_1$ to $C_1$ from the latch circuits 184*a* to 184*c* are coupled to respective AND gates 211*a* to 211*c*, and the minute data $A_2$ to $C_2$ from the latch circuits 206*a* to 206*c* are coupled to respective AND gates 212*a* to 212*c*. The data S in the counter 197 shown in FIG. 17 is coupled to an AND gate 211*d*. The AND gates 211*a* to 211*d* and 212*a* to 212*c* are controlled for gating by the schedule display signal x, and their outputs are coupled to respective decoders 213*a* to 213*d* and 214*a* to 214*c*. The outputs of the decoders 213*a* to 213*c* are supplied as drive signals to the respective digital "hour" data display electrode sets 118*a* to 118*c* in the schedule display section 116, and the output of the decoder 213*d* is supplied as drive signal to the data setting electrode 120 in the section 116. The outputs of the decoders 214*a* to 214*c* are supplied as drive signals to the respective analog "minute" data display electrode sets 119*a* to 119*c* in the section 116. The time information from the time counting circuit 3 is coupled through an AND circuit 215 and a decoder 216 to the time display section 115. The AND gate 215 is controlled for gating by the normal mode signal N and time display signal y. In this embodiment, the individual components circuits are operated in synchronism with the falling of the clock pulses.

Figure 19A:
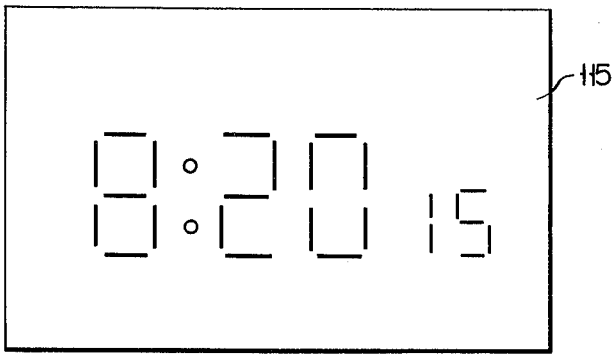
FIGS. 19A to 19B are views showing examples of the display in the display unit 114.

The operation of the above construction according to the invention will now be described. Normally, the flip-flops 131 and 133 in the input control circuit 112 shown in FIG. 16 are in the reset state, so that the normal mode signal N and time display signal y are "1". Thus, the AND gate 215 in the display control circuit 113 in FIG. 18 are open, and the time information from the time counting circuit 3 in FIG. 14 is supplied through the decoder 216 to the time display section 114 as shown in FIG. 19A.

Figure 19B:
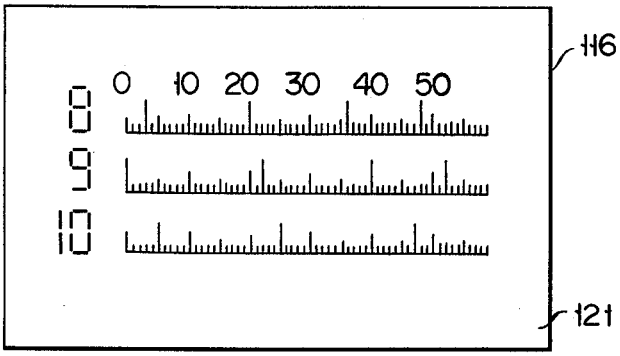
Figure 20:
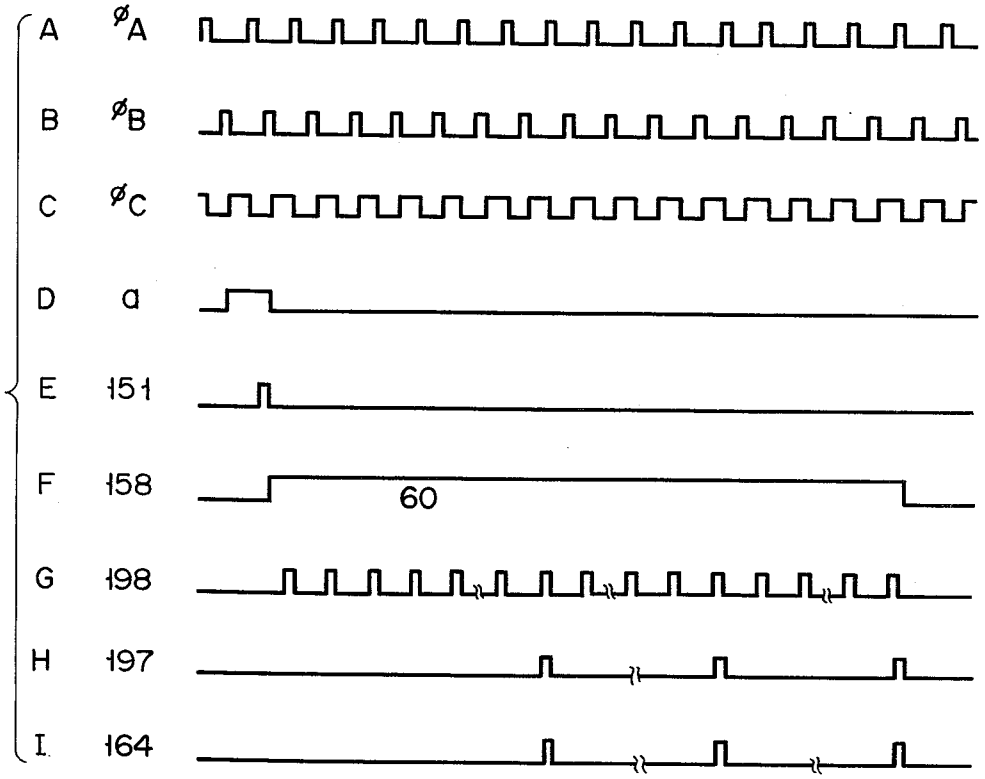
FIGS. 20A to 20I show a time chart illustrating the operation of schedule control circuit 110 shown in FIG. 17 at the time of mode switching.

For switching the above time display mode over to the schedule display mode as shown in FIG. 19B, the switch $S_{12}$ in the input section 111 shown in FIG. 16 is operated. With the operation of the switch $S_{12}$ a one-shot pulse is produced from the one-shot circuit 125 and coupled to the AND gate 132. Since at this time a "1" signal produced from the $\overline{Q}$ side output terminal of the flip-flop 131 prevails at the AND gate 132, the output of the one-shot circuit 125 is coupled through the AND gate 132 to the flip-flop 133 and decoder 134. Since at this time "1" signals are coupled from the $\overline{Q}$ side output terminals of the flip-flops 131 and 133 to the decoder 134, the signal a as shown in FIG. 20D is supplied from the decoder 134 to the schedule control circuit 110. With the falling of the one-shot pulse produced from the one-shot circuit 125, the flip-flop 133 is inverted, so that a "1" signal is supplied as the Q side output of this flip-flop, i.e., the schedule display signal x, to the display control circuit 113. In the display control circuit 113, with the schedule display signal x supplied the AND gates 211*a* to 211*c* and 212*a* to 212*c* are opened. At this time, the time display signal y is inverted to "0" to close the AND gate 215 in the display control circuit 113, thus disabling the coupling of the time information to the time display section 115.

Meanwhile, in the schedule control circuit 110, with the display switching signal a supplied from the decoder 134 in the input control circuit 112 a "1" signal is produced from the AND gate 151 as shown in FIG. 20E in synchronism with the clock pulse signal $\emptyset_B$, and is coupled to the AND gate 178 and flip-flop 158. With the falling of this pulse the flip-flop 158 is set to produce a "1" signal from its Q side output terminal. This signal is coupled to the AND gate 164 and is also coupled through the OR gate 163 to the AND gate 193. Meanwhile, with the output of the AND gate 151 the AND gate 178 is opened, so that the time information supplied from the time counting circuit 3 is gated through the AND gate 178 to be loaded as "hour" data in the address counter 179. The time data loaded in the address counter 179 is coupled to the AND gate 193. Since at this time the AND gate 193 is receiving the output of the flip-flop 158 coupled through the OR gate 163 and also a "1" signal from the inverter 194, the time information in the address counter 179 is read out as address data through the AND gate 193 and OR gate 195 to the RAM 196. At this time, the RAM 196 is in the read mode with the output of "0" from the AND gate 157 inverted through the inverter 201 and coupled as "1" signal to its read/write terminal R/W. Thus, when the clock pulse signal $\emptyset_C$ as shown in FIG. 20C is subsequently supplied to the enable terminal E of the RAM 196, the content thereof is read out according to the address data coupled from the OR gate 195 and also the content of the address counter 197. Since at this time the output of the flip-flop 158 as shown in FIG. 20F is coupled through the OR gate 163 to the AND gate 198, clock pulses $\emptyset_A$ as shown in FIG. 20G are gated through the AND gate 198 and coupled through the OR gate 199 to the address counter 197. The address counter 197 up-counts the successive clock pulses $\emptyset_A$ coupled to it through the OR gate 199 and specifies row addresses in the RAM 196. When the present time is, for instance, "8:20" as shown in FIG. 19A, in the RAM 196 an address for the hour zone for "8 o'clock" is specified by the 5-bit column address data, while the corresponding minute address is specified by the 6-bit row address data from the RAM 196. Thus, the schedule for the 8 o'clock hour zone is read out from the RAM 196 and written in the shift register 202. When the reading of the schedule for the 8 o'clock hour zone is ended, a carry signal is produced from the address counter 197 as shown in FIG. 20H. This carry signal is coupled through the AND gate 164 to the three-scale of counter 165 as shown in FIG. 20I to change the content of the counter by "+1". The output of the AND gate 164 is also coupled through the OR gate 186 to the AND gates 183*a* to 183*c* and 205*a* to 205*c* to open these gates. Thus, the time data representing 8 o'clock loaded in the address counter 179 at this time is latched through the AND gate 184*a* to the shift register 202, and the minute data in the 8 o'clock hour zone stored in the shift register 202 is latched through the latch circuit 205*a* to the latch circuit 206*a*. Further, the output of the AND gate 164 is coupled through the OR gate 181 to the address counter 179 to change the content thereof by "+1". With this up-counting action, the content of the address counter 179 becomes "9", so that the address for the 9 o'clock hour zone in the RAM 196 is specified. Thus, the schedule for the 9 o'clock hour zone is read out from the RAM 196 to the shift register 202 according to row address specification changing with the up-counting action of the RAM 196. When the reading of the schedule for the 9 o'clock hour zone from the RAM 196 is ended, a carry signal is produced from the address counter 197, thus changing the content of the counter 165 to "2". At the same time, the AND gates 183*a* to 183*c* and 205*a* to 205*c* are opened by the signal from the address counter 197 coupled through the AND gate 164 and OR gate 186, thus causing shift of the contents of the latch circuits 184*a* and 206*a* through the respective AND gates 183*b* and 205*b* to the respective latch circuits 184*b* and 206*b*. Also, the content of the address counter 179 representing "9 o'clock" is latched through the AND gate 183*a* to the latch circuit 184*a*, and the content of the shift register 202 is latched through the AND gate 205*a* to the latch circuit 206*a*. Further, with the output of the AND gate 164 the content of the address counter 179 is changed by "+1" to "10", so that in the RAM 196 the address for the "10 o'clock" hour zone is specified. In the above way, schedules for successive one-hour zones are read out from the RAM 196 and are latched in the latch circuits 206*a* to 206*c*. Also, hour data representing the respective hour zones read out from the address counter 179 are latched in the latch circuits 184*a* to 184*c*. When the schedule for three hours is read out from the RAM 196, the three-scale of counter counting the signal coupled from the address counter 197 through the AND gate 164 produces a carry signal. With this carry signal the flip-flop 158 is reset, and a "0" signal is thus coupled therefrom to the AND gates 193 and 198 to close these gates, thus disabling the address specification in the RAM 196. The hour data $A_1$ to $C_1$ stored in the latch circuits 184*a* to 184*c* and minute data stored in the latch circuits 206*a* to 206*c* are supplied to the display control circuit 113 shown in FIG. 18. Since at this time the schedule display signal x prevails at the AND gates 211*a* to 211*d* and 212*a* to 212*c* in the display control circuit 113, the minute data supplied from the display control circuit 113 is coupled through the AND gates 212*a* to 212*c* to the decoders 214*a* to 214*c*. The hour data are decoded in the decoders 213*a* to 213*c* to produce drive signals coupled to the digital hour display electrode sets 118*a* to 118*c* in the schedule display section 116. Thus, the digital display electrode sets 118*a* to 118*c* are driven to display hour data, for instance "8", "9" and "10" as shown in FIG. 19B. The minute data are decoded in the decoders 214*a* to 214*c* to produce drive signals coupled to the analog display electrode sets 119*a* to 119*c* in the schedule display section 116. Thus, the analog display electrode sets 119*a* to 119*c* are driven to made analog display of minute data for the 8, 9 and 10 o'clock hour zones as shown in FIG. 19B. The minute data displayed as analog display can be easily read out for the scales 122*a* to 122*c* are printed on the transparent plate 121.

Figure 21:
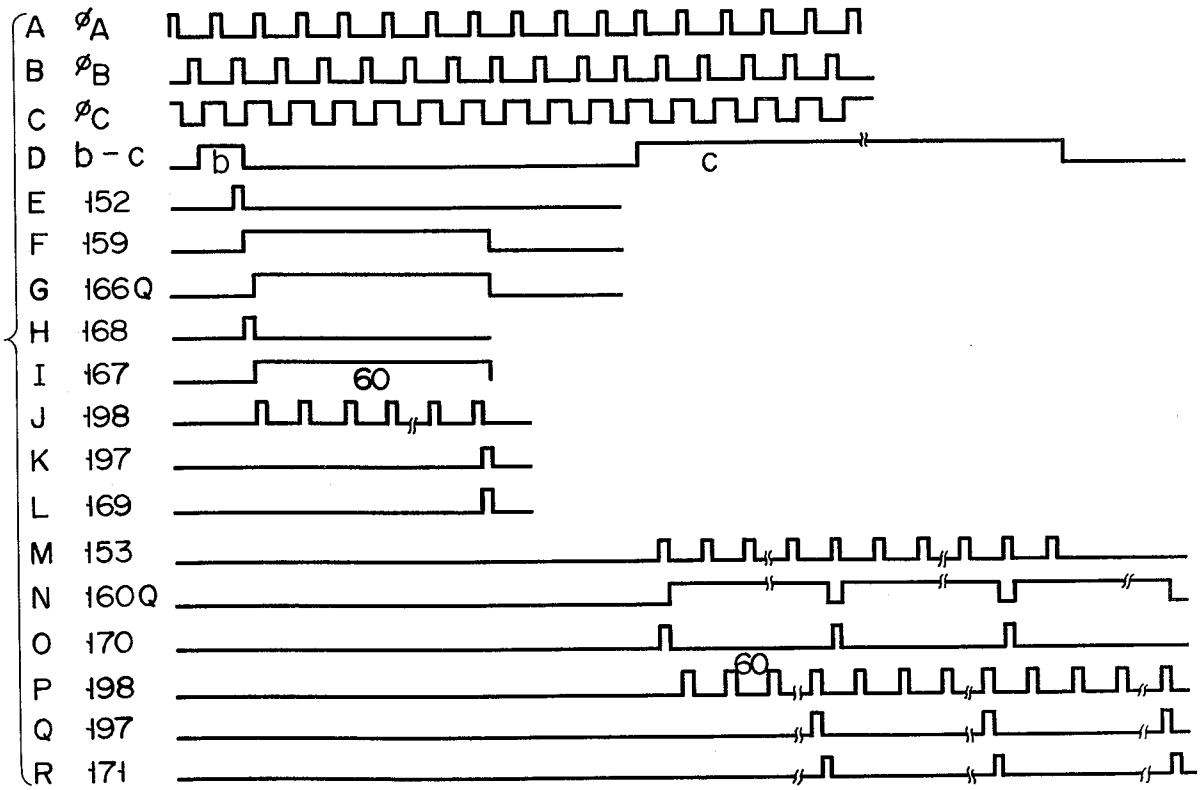
FIGS. 21A to 21R form a time chart illustrating the operation of schedule the control circuit 110 shown in FIG. 17A and FIG. 17B at the time of changing displayed data in the schedule display mode.

Now, the operation as well as how to cause operation of displaying other time data memorized as schedule data in the memory than those which are displayed in the schedule display section as shown in FIG. 19B will be described. For causing display of time instant later than those displayed in the schedule display section 116, the switch $S_{13}$ is operated. In this case, by depressing the switch $S_{13}$ intermittently for short periods of time shorter than 3 seconds the display is changed to one different by one hour every time the switch is operated, while by continuously operating the switch $S_3$ for longer than 3 seconds the display can be continuously changed. In a case where the switch $S_{13}$ is depressed for a short period of time less than 3 seconds, a one-shot pulse in the one-shot circuit 126 in the input control circuit 112 shown in FIG. 16 is produced and coupled to the AND gate 139. At this time, the flip-flop 137 is in the reset state, with a "1" signal being produced from its $\overline{Q}$ side output terminal and coupled to the AND gate 139. The output of the one-shot circuit 126 is thus coupled through the AND gate 139 to the decoder 134. When the normal mode signal N and schedule display signal x prevail, with the "1" signal coupled from the AND gate 139 the decoder 134 produces the signal b as shown in FIG. 21D. This signal b is supplied to the schedule control circuit 110 shown in FIG. 17. In the schedule control circuit 110, the signal b supplied from the decoder 134 is coupled to the AND gate 152, and it is gated therethrough as shown in FIG. 21E is synchronism with the AND gate 152. With the output from the AND gate 152 the flip-flop 159 is set, so that a "1" signal is produced from the Q side output terminal of this flip-flop as shown in FIG. 21F and coupled to the flip-flop 166 and AND gates 167 and 168. At this time, the flip-flop 166 is in the reset state, with "1" output signal being produced from its $\overline{Q}$ side output terminal.

Figure 19C:
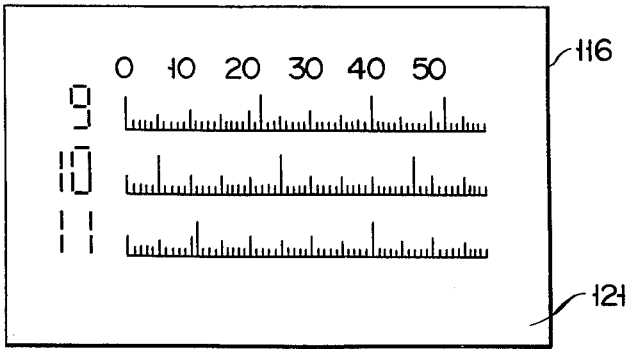

Thus, with the setting of the flip-flop 159 a "1" signal is produced from the AND gate 168 as shown in FIG. 21H and coupled through the OR gate 181 to the address counter 179. Since at this time the address counter 179 has the same content as that when the schedule data has been previously read out from the RAM 196, for instance "10" in the example of FIG. 19B, with the signal coupled through the OR gate 181 the address counter content is changed to the next greater value, namely "11". Meanwhile, with the output of the flip-flop 159 the flip-flop 166 is set and produces a "1" signal from its Q side output terminal as shown in FIG. 21G. As a result, "1" signal is produced from the AND gate 167 as shown in FIG. 21I and coupled through the OR gate 163 to the AND gate 193. Thus, the AND gate 193 is opened, so that the content "11" of the address counter 179 is coupled through the AND gate 193 and OR gate 195 to the RAM 196 for specifying the address for the "11 o'clock" hour zone. The output of the OR gate 163 is coupled to the AND gate 198 to open this gate. Thus, clock pulses $\emptyset_A$ are gated through the AND gate 198 as shown in FIG. 21J and coupled through the OR gate 199 to the address counter 197. The address counter 197 thus effects progressive up-counting in synchronism with the input clock pulses $\emptyset_A$ for specifying successive row addresses in the RAM 196. By this address specification, the schedule for the 11 o'clock hour zone is read out from the RAM 196 and written in the shift register 202. When the reading of the schedule for the 11 o'clock hour zone is ended so that the address counter 197 produces a carry signal as shown in FIG. 21K, this carry signal is coupled through the AND gate 169 as shown in FIG. 21L to reset the flip-flops 159 and 166. The output of the AND gate 169 is also coupled through the OR gate 186 to the AND gates 183*a* to 183*c* and 205*a* to 205*c* to open these gates. Thus, the content "11" of the address counter 179 is latched through the AND gate 183*a* to the latch circuit 184*a*, and also the contents "10" and "9" in the respective latch circuits 184*a* to 184*b* are shifted through the respective AND gates 183*b* and 183*c* to the respective latch circuits 184*b* and 184*c*. At the same time, the minute data for the 11 o'clock hour zone stored in the latch circuit 206*a* is latched in the latch circuit 206*a*, and the contents of the latch circuits 206*a* and 206*b* are shifted through the respective AND gates 205*b* and 205*c* to the latch circuits 206*b* and 206*c*. The hour data latched in the latch circuits 184*a* to 184*c* and minute data latched in the latch circuits 206*a* to 206*c* are supplied to the display control circuit 113, so that schedule for the 9 to 11 o'clock hour zones is displayed in the schedule display section 116 as shown in FIG. 19C.

In a case where the switch $S_{13}$ is continuously operated for longer than 3 seconds, the signal b is produced from the decoder 134 in the input control circuit 112 shown in FIG. 16, and also the output of the switch $S_{13}$ is coupled through the OR gate 135 to the AND gate 136 to open this gate. Thus, one-second signal 1P/S is supplied through the AND gate 136 to the three-scale of counter 138 and up-counted thereby. When three pulses of the one-second signal 1P/S are counted by the counter 138, a "1" signal is produced therefrom to set the flip-flop 137. Thus, the flip-flop 137 produces a "1" signal from its Q side output terminal to open the AND gate 134, so that the output of the switch $S_{13}$ is coupled through the AND gate 141 to the decoder 134. In the presence of the normal mode signal N and schedule display signal x, with the "1" signal supplied from the AND gate 141 the decoder 134 produces the signal c. In the schedule control circuit 116 shown in FIG. 17, with the signal c supplied from the decoder 134 the AND gate 153 is opened, so that clock pulses $\emptyset_B$ are coupled through the AND gate 153 as shown in FIG. 21M. The output of the AND gate 153 is passed through the AND gate 170 as shown in FIG. 210 to be coupled through the OR gate 181 to the address counter 179, thus changing the content of the address counter 179 by "+1". With the output of the AND gate 153 the flip-flop 160 is set, so that the Q side output thereof is coupled through the OR gate 163 as shown in FIG. 21N. The output of the OR gate 163 is shown in FIG. 21N. With the output of the OR gate 163 the AND gate 193 is opened, so that the content of the address counter 179 is coupled through the AND gate 193 and OR gate 195 to the RAM 196. Also, with the output of the OR gate 163 the AND gate 198 is opened, so that clock pulses $\emptyset_A$ are gated through the AND gate 198 as shown in FIG. 21P to be coupled to the address counter 197 and successively up-counted therein. According to the content of the address counter 197 the content of the RAM 196 is read out and written in the shift register 202. When the address counter 197 produces a carry signal as shown in FIG. 21Q, this signal is coupled through the AND gate 171 as shown in FIG. 21R, thus resetting the flip-flop 160. The output of the AND gate 171 is also coupled through the OR gate 186 to the AND gates 183*a* to 183*c* and 205*a* to 205*c* to open these gates. In this way, the contents of the latch circuits 184*a* to 184*c* and 206*a* to 206*c* are shifted to the next schedule data. While the switch $S_{13}$ is being operated, the above operation is repeatedly effected, and the schedule data in the latch circuits 184*a* to 184*c* and 206*a* to 206*c* are progressively shifted. When the switch $S_{13}$ is released, i.e., opened, with the falling of the output thereof the counter 138 in the input control circuit 112 is reset, and also the output signal c of the decoder 134 is changed to "0" to bring an end to the up-counting operations in the address counters 179 and 197 in the schedule control circuit 110. Also, the data $A_1$ to $C_1$ and $A_2$ to $C_2$ stored in the latch circuits 184*a* to 184*c* and 206*a* to 206*c* at this time are displayed in the schedule display section 116.

Figure 22:
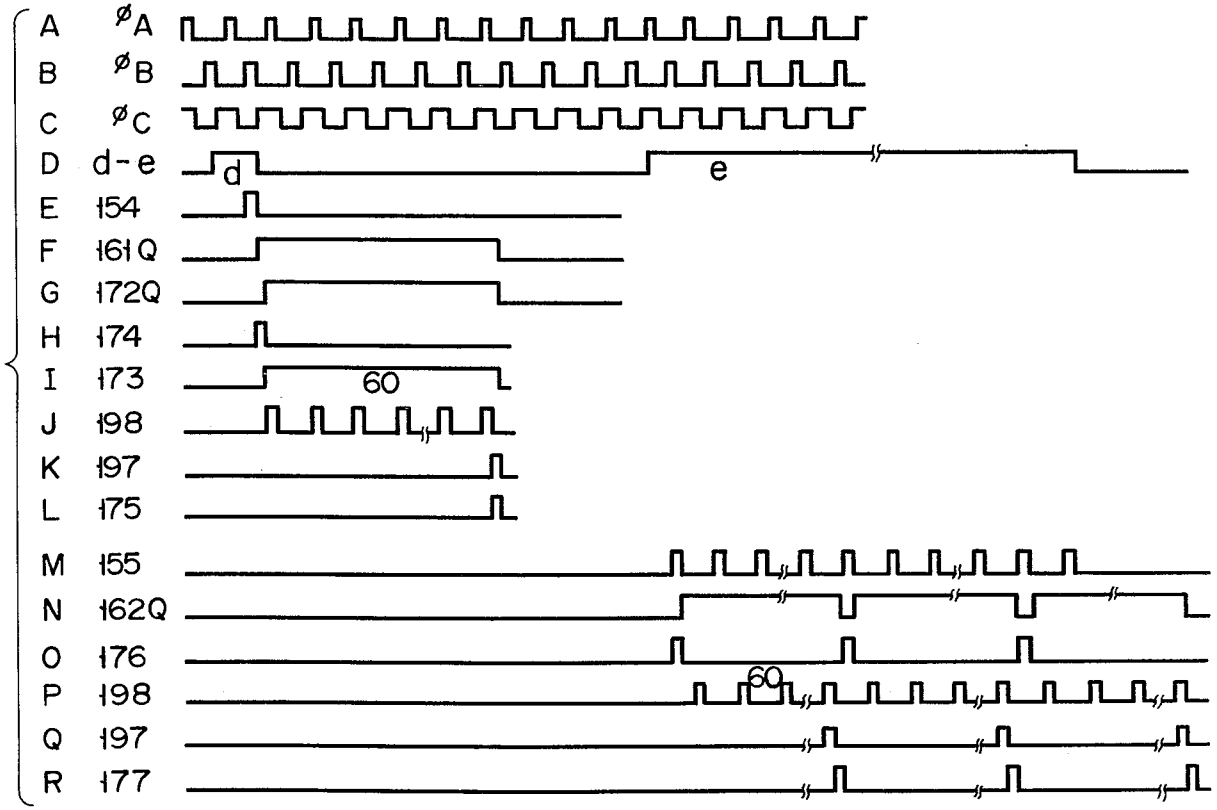
FIGS. 22A to 22R form a time chart illustrating the operation of the schedule display circuit 110 shown in FIGS. 17A and 17B at the time of changing the displayed data in the schedule display mode.

While the operation that takes place when causing the display of schedule data representing time instants later than those displayed as schedule display has been described, for causing the display of time instants earlier than those displayed the switch $S_{14}$ is operated, whereby similar display control can be obtained. FIGS. 22A to 22R show a timing chart for the case when the switch $S_{14}$ is operated, and the detailed description of the operation in this case is omitted.

Figure 23:
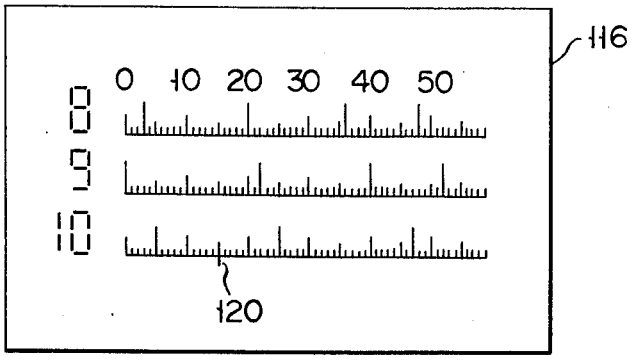
FIG. 23 is a view showing an example of the display in the display unit 114 in the presetting mode.

Now, the operation in case when correcting the schedule memorized in the RAM 196 will be described. In this case, the presetting mode is set by operating the switch $S_{11}$ when the system is in a state in which schedule data, for instance as shown in FIG. 23, are displayed. With the operation of the switch $S_{11}$, a one-shot pulse is produced from the one-shot circuit 124 in the input control circuit 112 shown in FIG. 16. This one-shot pulse is supplied as presetting signal P' through the AND gate 130 to the display control mode circuit 110. The output of the one-shot circuit 124 is also coupled through the AND gate 130, and with its falling the flip-flop 131 is inverted. As a result, the presetting signal P is produced from the flip-flop 131 and supplied to the schedule control circuit 110 shown in FIG. 17. In the schedule control circuit 110, the AND gate 192 is opened by with the presetting signal P, so that the hour data stored in the address counter 179 is coupled through the AND gate 192 and OR gate 195 to the RAM 196. In the RAM 196, the corresponding column address is specified by the data from the address counter 179. Meanwhile, with the operation of the switch $S_{13}$ up-counting operation of the address counter 197 is caused to be brought about for specifying successive row addresses in the RAM 196. More particularly, when the switch $S_{13}$ is operated, a one-shot pulse is produced from the one-shot circuit 126 and is coupled through the AND gate 139 to the decoder 134. Since at this time the presetting mode signal P and schedule display signal x are supplied to the decoder 134, the decoder 134 produces the signal f. This signal f is coupled to the AND gate 156 shown in FIG. 17 to open this gate. Thus, one clock pulse $\emptyset_A$ is produced from the AND gate 156 and coupled through the OR gate 199 to the address counter 197 to change the content thereof by "+1". In this way, every time the switch $S_{13}$ is operated the content of the address counter 197 is changed by "+1". The output data S of the address counter 197 is coupled through the AND gate **211*d* to the decoder 213*d*. The decoder 213*d* decodes the input data to produce a drive signal for driving the presetting display electrode set 120. In the presetting display electrode set 120, electrodes in the row are successively driven from the left end one according to the up-counting operation of the address counter 197. The presetting display position corresponds to that in the lowest analog display electrode set 119*c* in the schedule display section 116. If it is not intended to change the display content of the analog display electrode set 119*c* specified by the presetting display electrode set 120, the presetting display is caused to proceed by operating the switch $S_{13}$. If it is intended to change the display content, the switch $S_{15}$ is operated. As a result, a one-shot pulse is produced from the one-shot circuit 128 shown in FIG. 16 and coupled to the decoder 134. With the output of the one-shot circuit 128 coupled the decoder 134 produces the signal g, which is supplied to the display control circuit 110 shown in FIG. 17. In the display control circuit 110, with the signal g coupled from the decoder 134 the AND gate 157 is opened, so that one clock pulse $\emptyset_A$ is produced from the AND gate 157. As a result, the output of the inverter 201 is changed to "0", and write command is supplied to the RAM 196. At this time, the content of the RAM 196 in the address specified by the address counters 179 and 197 has been read out to the flip-flop 203, with the output thereof being coupled after inversion through the inverter 204 to the data input terminal $D_{IN}$ of the RAM 196. Thus, with a write instruction given to the RAM 196 with the operation of the switch $S_{15}$, the output of the inverter 204 is written in the RAM 196**. In the above way, the presetting or correction of schedule data can be obtained by operating the switch $S_{13}$ or $S_{15}$.

Figure 24A:
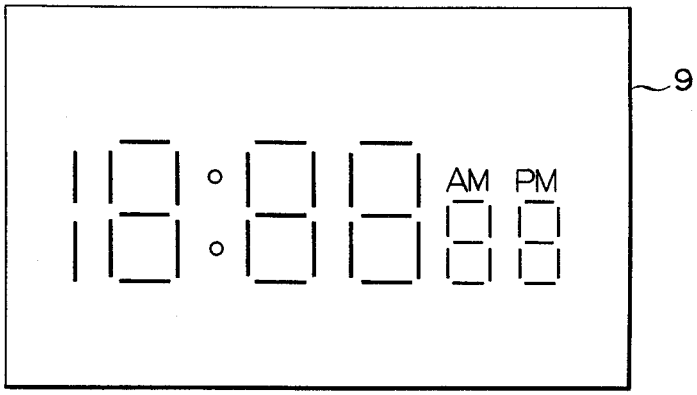
FIGS. 24A and 24B are views showing upper and lower display sections in a different example of the display unit 114.
Figure 24B:
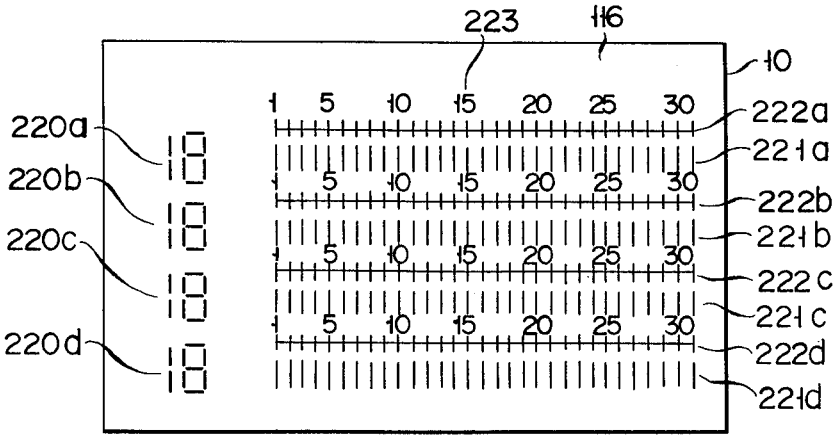
Figure 25A:
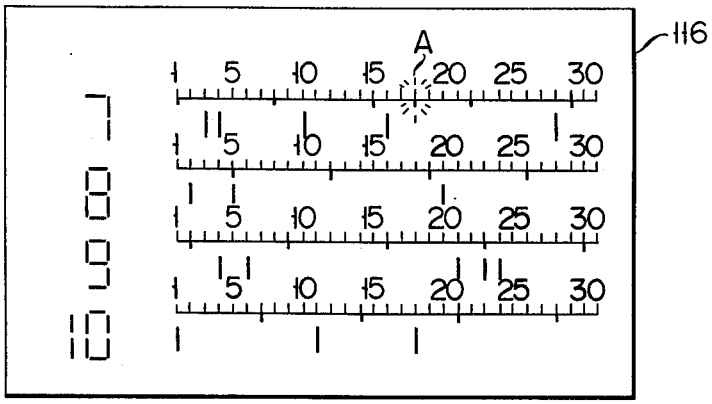
FIGS. 25A and 25B are views showing examples of the display in the display unit 114 shown in FIGS. 24A and 24B.
Figure 25B:
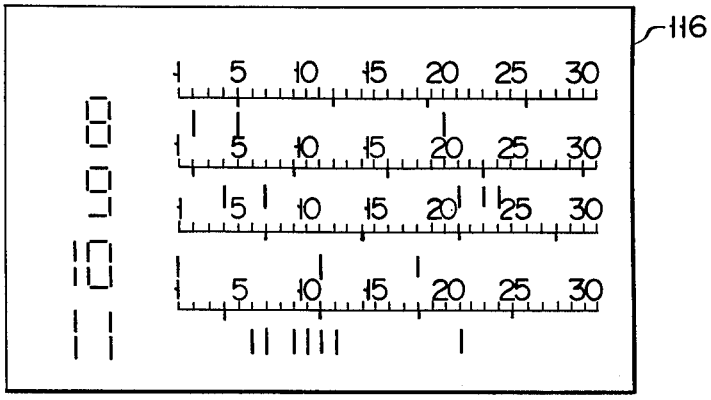

While in the above embodiment "hour" and "minute" data are displayed as schedule display, it is also possible to display other data such as "month" and "day" data as the schedule data, for instance as shown in FIGS. 24A and 24B. In this example, schedule display section 116 has digital display electrode sets **220*a* to 220*d* for displaying "month" data and analog display electrode sets 221*a* to 221*d* for displaying "day" data and also "weekday" data. The analog display electrode sets 221*a* to 221*d* each consist of 31 parallel bar electrodes for displaying the "day" data. The display section further has 31 electrodes provided above the analog display electrode sets and corresponding to the respective bar electrodes in the individual analog display electrode sets for displaying the "weekday" data. Further, transparent plate 116 has an impression of scales 222*a* to 222*d* corresponding to the respective analog display electrode sets 222*a* to 222*d* and also figure marks "1", "5", . . . , "30", designated at 223, above these scales at an internal of five graduations from the left end. With this construction of the schedule display section 116, it is possible to display "month" and "day" data as schedule display. FIGS. 25A and 25B show examples of the display in the schedule display section 116 shown in FIGS. 24A and 24B. In the example of FIG. 25A, Sundays and holidays are displayed by weekday display electrodes, and a weekday display electrode A corresponding to the present day is driven to blink. FIG. 25B shows an example of the display, which is obtained as a result of upward shifting of the display of FIG. 25A** by one row caused by switch operation.

The time data displayed is not limited to the "hour" and "minute" data and "month" and "day" data. It is possible to display various other time data such as "day" and "hour" data, "weekday", "hour" and "minute" data and "year", "month" and "day" data.

What is claimed is:

1. An electronic time display device for selectively displaying present time and a plurality of set time data items, comprising:

time counting means for generating present time data representing the present time;

first optical display means coupled to said time counting means for normally displaying the present time data generated by said time counting means;

memory means for storing a plurality of set time data items;

read-out control means coupled to said memory means for reading out at least two consecutive set time data items from said memory means;

first manually operable switch means coupled to said read-out control means for supplying a read-out instruction to said read-out control means, when operated;

second optical display means including at least two display sections for simultaneously displaying respective ones of at least two consecutive set time data items read out by said read-out control means by operation of said first manually operable switch means;

second manually operable switch means coupled to said memory means for reading from said memory means, when operated, a new set time data item occurring immediately after the at least two consecutive set time data items displayed by said second optical display means; and display control means coupled to said second optical display means for causing said second optical display means to shift the previously displayed consecutive set time data items by one set time item to thereby erase the first of the at least two consecutive set time data items which were displayed and move the display of the second of the at least two consecutive set time data items to the position at which said erased set time data item was displayed, when said new set time data item occurring immediately after these previously displayed consecutive set time data items is read out from said memory means by operation of said second manually operable switch means, and said display control means then causing displaying of said new set time data item newly read out from said memory means at one of the display sections of said second optical display means which became vacant due to said shifting of said previously displayed consecutive set time data items.

2. An electronic time display device according to claim 1, wherein said memory means stores at least two groups of set time data items, and said second optical display means has at least two display units provided for the two groups of set time data items stored in said memory means, respectively, each of said display unit being adapted to display at least two consecutive set time data items of the corresponding group of set time data items read from said memory means when said first manual switch means is operated.

3. An electronic time display device according to claim 1, wherein each set time data item includes upper time unit data and lower time unit data, said upper time unit data being hours and said lower time unit data being minutes.

4. An electronic time display device according to claim 1, wherein said second optical display means is laid over said first optical display means.

5. An electronic time display device for selectively displaying present time and a plurality of set time data items, comprising:

time counting means for generating present time data representing the present time;

first optical display means coupled to said time counting means for normally displaying the present time data generated by said time counting means;

memory means for storing a plurality of set time data items, each set time data item including upper time unit data and lower time unit data;

first read-out means coupled to said memory means for reading out from said memory means at least two groups of set time data items having the same upper time unit data;

second optical display means including a digital display section for displaying the same upper time unit data of the set time data items read out from said memory means by said first read-out means and a plurality of analog display sections for displaying the lower unit time data of the set time data items read out from said memory means by said first read-out means;

second read-out means coupled to said memory means for reading from said memory means a new group of set time data items including upper time unit data next greater than the upper item unit data displayed by said second optical display means; and display control control means coupled to said second optical display means for causing said second optical display means to shft the previously displayed set time data items by one group of set time data items to thereby erase the first group of set time data items which was previously displayed and move the display of the second of the previously displayed group of set time data items to the position at which said erased group of set time data items was displayed, when said new group of set time data items including the next greater time unit data are read out from said memory means by said second read-out means, and said display control means then causing displaying of said new group of set time data items newly read out from said memory means at one of the display sections of said second optical display means which became vacant due to said shifting.

6. An electronic time display device according to the claim 5, wherein said upper time unit is hours and said lower time unit is minutes.

7. An electronic time display device according to claim 5, wherein said first optical display means and said second optical display means are laid one over the other.

8. An electronic time display device for selectively displaying present time and a plurality of set time data items comprising:

time counting means for generating present time data representing the present time;

a first optical display means for normally displaying the present time data generated by said time counting means;

memory means for storing a plurality of set time data items;

first read-out control means coupled to said memory means for reading out from said memory means a predetermined number of consecutive set time data items occurring at a time after the present time shown by said first optical display means;

second optical display means including a predetermined number of display sections for displaying respective ones of said consecutive set time data items read out from said memory means by said first read-out control means;

second read-out control means coupled to said memory means for reading out from said memory means a new set time data item occurring immediately after the consecutive set time data items displayed by said second optical display means; and display control means coupled to said second optical display means for causing said second optical display means to shift the previously displayed consecutive set time data items by one set time data item to thereby erase the first of the consecutive set time data items which were previously displayed and move the display of the second of the previously displayed set time data items to the position at which said erased set time data item was displayed, when said new set time data item occurring immediately after the previously displayed consecutive set time data items is read out from said memory means by said second read-out control means, and said display control means then causing displaying of said new set time data item newly read out from said memory means at one of the display sections of said second optical display means which became vacant due to said shifting of said previously displayed consecutive set time data items.

9. An electronic time display device according to claim 8, wherein said first optical display means and said second optical display means are laid one over the other.

10. An electronic time display device according to claim 8, wherein said memory means stores at least two groups of set time data items, said second optical display means has at least two display units provided for the two groups of set time data items stored in said memory means, respectively, each of said display units being adapted to display at least two consecutive set time data items of the corresponding group read out from said memory means when said first read-out control means is operated.

11. An electronic time display device according to claim 8, wherein each set time data item includes upper time unit data and lower time unit data, set upper time unit data being hours and said lower time unit data being minutes.

12. An electronic time display device according to claim 1, wherein said at least two display sections of said second optical display means are vertically arranged one above the other for respectively displaying consecutive set time data items, said display control means causing shifting of the previously displayed consecutive time data items in a vertical direction.

13. An electronic time display device according to claim 12, wherein said display control means causes shifting of said previously displayed consecutive time data in an upward vertical direction so that the uppermost-positioned set time data item previously displayed is deleted, and said new set time data item is displayed at the lowermost position on said second optical display means.

14. An electronic time display device according to claim 5, wherein at least said analog display sections of said second optical display means are vertically arranged one above the other for respectively displaying consecutive lower unit time data of said set time data items, said display control means causing shifting of the previously displayed lower unit time data of said set time data items in a vertical direction.

15. An electronic time display device according to claim 14, wherein said display control means causes shifting of said previously displayed lower unit time data in an upward vertical direction so that the uppermost-positioned set time data item previously displayed is deleted, and said new set time data item is displayed at the lowermost position on said second optical display means.

16. An electronic time display device according to claim 8, wherein said display sections of said second optical display means ae vertically arranged one above the other for respectively displaying consecutive set time data items, said display control means causing shifting of the previously displayed consecutive time data items in a vertical direction.

17. An electronic time display device according to claim 16, wherein said display control means causes shifting of said previously displayed consecutive time data in an upward vertical direction so that the uppermost-positioned set time data item previously displayed is deleted, and said new set time data item is displayed at the lowermost position on said second optical display means.

* * * * *

UNITED STATES PATENT AND TRADEMARK OFFICE

CERTIFICATE OF CORRECTION

PATENT NO. : 4,485,463

DATED : November 27, 1984

INVENTOR(S) : Kazunori KITA

It is certified that error appears in the above-identified patent and that said Letters Patent is hereby corrected as shown below:

COLUMN 20, line 61, change "Fig. 21E is" to --Fig. 21E in--;

COLUMN 25, line 56, after "means to" change "shft" to --shift--;

COLUMN 28, line 13, after "display means" change "ae" to --are--.

Signed and Sealed this

*Sixteenth* Day of *July 1985*

[SEAL]

*Attest:*

DONALD J. QUIGG

*Attesting Officer* *Acting Commissioner of Patents and Trademarks*